US008708103B2

(12) United States Patent
Bulley

(10) Patent No.: US 8,708,103 B2
(45) Date of Patent: Apr. 29, 2014

(54) JOINTS FOR A STAND

(75) Inventor: Dan Bulley, British Columbia (CA)

(73) Assignee: Quick Products, Inc., Kelowna, BC (CA)

( * ) Notice: Subject to any disclaimer, the term of this patent is extended or adjusted under 35 U.S.C. 154(b) by 279 days.

(21) Appl. No.: 12/396,675

(22) Filed: Mar. 3, 2009

(65) Prior Publication Data

US 2010/0224446 A1 Sep. 9, 2010

(51) Int. Cl.
*B25H 1/06* (2006.01)

(52) U.S. Cl.
CPC ..... *B25H 1/06* (2013.01)
USPC ..... 182/185.1; 182/153; 182/181.1; 182/186.3; 182/186.5

(58) Field of Classification Search
USPC ..... 182/186.3, 186.5, 185.1, 181.1, 224, 182/153
See application file for complete search history.

(56) References Cited

U.S. PATENT DOCUMENTS 1,601,946 A * 10/1926 Dujardin ..... 182/224
1,780,579 A * 11/1930 Crowley ..... 182/224
1,996,761 A * 4/1935 Gould et al. ..... 182/224
2,136,420 A * 11/1938 Edwards ..... 182/226
2,249,685 A * 7/1941 Dearing ..... 256/64
2,501,656 A * 3/1950 Anderson ..... 182/185.1
3,233,701 A * 2/1966 Hentzi et al. ..... 182/155
3,269,487 A * 8/1966 Larson ..... 182/155
3,374,591 A * 3/1968 Papalia et al. ..... 52/241
3,530,956 A * 9/1970 Jadek ..... 182/186.2
3,978,943 A 9/1976 Greenman et al.
D251,018 S 2/1979 Lockwood
4,192,406 A * 3/1980 Mitchell ..... 182/185.1
4,238,001 A 12/1980 Alexander
4,260,040 A 4/1981 Kieffer
4,278,148 A 7/1981 Daley et al.
4,325,463 A 4/1982 Taylor
4,375,245 A 3/1983 Schill
4,390,081 A 6/1983 Olmsted
4,461,370 A 7/1984 Connell
4,469,307 A 9/1984 Bell
4,489,808 A 12/1984 Voye
4,508,194 A 4/1985 Freewalt et al.
4,515,243 A 5/1985 Prior
4,605,099 A 8/1986 Crum et al.
4,672,785 A * 6/1987 Salvo ..... 52/241
4,681,187 A 7/1987 Brown
4,730,698 A 3/1988 Harris
4,770,274 A * 9/1988 Middleton ..... 182/186.3
4,785,911 A 11/1988 Kayl
4,804,064 A 2/1989 Coultrup et al.
4,836,332 A 6/1989 Henson
4,880,080 A 11/1989 Brockman (Continued)

OTHER PUBLICATIONS

"Injection molding" from wikipedia, the free encyclopia http://en.wikipedia.org/wiki/Injection_molding.

(Continued)

*Primary Examiner* — Katherine Mitchell
*Assistant Examiner* — Colleen M Chavchavadze
(74) *Attorney, Agent, or Firm* — Wells, St. John, P.S.

(57) ABSTRACT

An interconnect structure of a support apparatus. The interconnect structure includes a channel configured to receive a portion of a cross member. The interconnect structure further includes a pair of openings oriented relative opposite sides of the channel, each opening configured to receive a leg member of the support apparatus. The interconnect structure is a single-piece structure.

20 Claims, 17 Drawing Sheets

(56) References Cited

U.S. PATENT DOCUMENTS

| | | | | |
|---|---|---|---|---|
| 4,884,658 | A | 12/1989 | Banfield | |
| 4,911,390 | A | 3/1990 | Flick | |
| 4,938,311 | A | 7/1990 | Combs | |
| 4,951,782 | A | 8/1990 | Hanson | |
| 4,967,877 | A | 11/1990 | Wallman et al. | |
| 5,052,517 | A | 10/1991 | Wallman et al. | |
| 5,096,019 | A | 3/1992 | Kelsay | |
| 5,102,078 | A | 4/1992 | Nordeng | |
| 5,103,933 | A * | 4/1992 | Huff | 182/18 |
| 5,141,077 | A | 8/1992 | Zuercher | |
| 5,170,861 | A | 12/1992 | Turner | |
| 5,193,598 | A | 3/1993 | Estrem | |
| 5,257,829 | A | 11/1993 | Weeks | |
| 5,265,697 | A | 11/1993 | Quick | |
| 5,297,655 | A | 3/1994 | Wolfe | |
| 5,303,891 | A | 4/1994 | Powers | |
| 5,314,041 | A * | 5/1994 | Jerrow et al. | 182/186.5 |
| 5,318,150 | A | 6/1994 | Donaho | |
| D352,788 | S | 11/1994 | Sheftel | |
| 5,377,780 | A * | 1/1995 | Dunaway | 182/185.1 |
| 5,427,200 | A | 6/1995 | Yemini | |
| 5,484,037 | A | 1/1996 | Neumarkel | |
| 5,538,102 | A | 7/1996 | Yemini | |
| D378,544 | S | 3/1997 | Aldredge | |
| 5,628,382 | A | 5/1997 | Hill | |
| 5,758,744 | A | 6/1998 | Forino | |
| 5,779,003 | A | 7/1998 | Carty | |
| 5,803,205 | A | 9/1998 | Kochem | |
| 5,813,495 | A | 9/1998 | Smith | |
| D408,086 | S | 4/1999 | Durapau | |
| 5,913,381 | A | 6/1999 | D'Armond, Jr. | |
| 6,298,946 | B1 | 10/2001 | Yemini et al. | |
| 6,564,903 | B2 | 5/2003 | Krajec | |
| 6,612,401 | B1 | 9/2003 | Price et al. | |
| 6,758,307 | B1 | 7/2004 | Ols | |
| 6,810,996 | B2 * | 11/2004 | Rump | 182/186.5 |
| 7,017,876 | B1 * | 3/2006 | LeCher | 248/300 |
| 7,021,424 | B2 * | 4/2006 | Herman | 182/224 |
| D535,758 | S | 1/2007 | Spreadborough | |
| 7,172,053 | B2 | 2/2007 | Slavich | |

OTHER PUBLICATIONS

"Malleability" malleable definition http://www.yourdictionary.com/malleability.

"Sawhorse" from Wikipedia, the free enclyclopedia, http://en.wikipedia.org/wiki/Sawhorse.

Die-Casting from Efunda, engineering fundamentals; http://www.efunda.com/processes/metal_processing/die_casting.cfm.

* cited by examiner

JOINTS FOR A STAND

TECHNICAL FIELD

This invention relates to support apparatuses, interconnect structures and methods of forming interconnect structures.

BACKGROUND OF THE INVENTION

A sawhorse is an exemplary support apparatus used at construction sites, buildings, businesses, and around dwellings. An exemplary sawhorse is configured with a crossbeam extending between a pair of two diverging leg members. A routine method to connect the leg members to the crossbeam is by simply nailing each leg member to the crossbeam. However, this routine configuration of a sawhorse has limited facility, is inadequate for heavy loads and is unstable even assuming human error is not a factor when nailing the leg members to the crossbeam. That is, this configuration for a sawhorse is more problematic when considering that the person nailing each leg member may be distracted, in a hurry or simply not competent.

Accordingly, the stability of this configuration of a sawhorse is not only dependent upon weak connections provided by nails, but also on the human factor of performing the nailing properly which at best is inconsistent, and at worst nonexistent. Moreover, only one of the four leg members needs to be unsatisfactorily connected to the crossbeam to make the sawhorse unstable and ineffective as a support apparatus, even for minimal loads. Accordingly, this configuration of a sawhorse greatly limits the versatility of the support apparatus due to the safety considerations associated with the weak connections.

Accordingly, there is a need to improve the consistency for stability with which leg members are connected to a crossbeam to increase the safety, and therefore the versatility, of the support apparatus. Furthermore, there is a need to improve the methods and devices used to connect the leg members to the crossbeam to increase load bearing capabilities of the support apparatus in contrast to the load bearing capabilities when using nails. Moreover, there is a need to simplify the methods and devices used to connect the leg members to the crossbeam to facilitate ease of use and consistency in the connection which again leads to versatility of use for the support apparatus.

BRIEF DESCRIPTION OF THE DRAWINGS

Preferred embodiments of the invention are described below with reference to the following accompanying drawings.

FIG. 13 is a perspective view of an exemplary system for forming an interconnect structure used in the method of FIG. 9 according to one of various embodiments of the invention.

FIG. 16 is a perspective view of an exemplary interconnect structure illustrating removal of sprue, heat sinks flashes during the method of FIG. 9 according to one of various embodiments of the invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
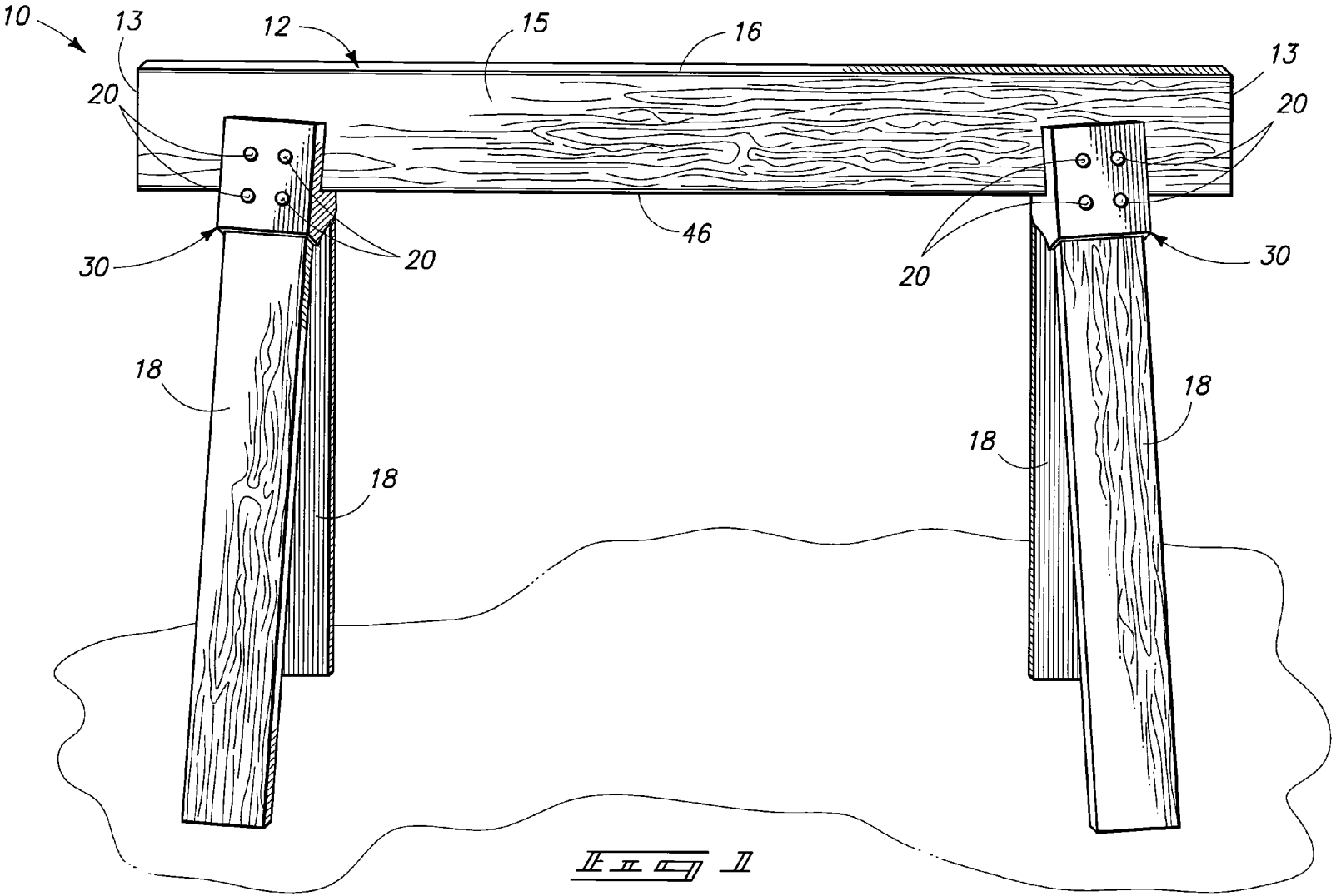
FIG. 1 is a perspective view of a support apparatus according to one of various embodiments of the invention.

Referring to FIG. 1, an exemplary support apparatus 10 according to one of various embodiments of the invention is illustrated. An exemplary support apparatus 10 has a cross member or crossbeam 12 supported by two sets of a pair of diverging legs 18 (support legs or members). Each pair of legs 18 are secured to, or interconnected with, the crossbeam 12 by an intermediary structure 30 proximate opposite ends of crossbeam 12. Alternatively, the intermediary structure 30 can be referred to as an interconnect structure or device 30 (still further, alternatively referred to as a bracket, brace, pivot structure or containment structure). Fasteners 20 secure legs 18 to interconnect structures 30. Exemplary fasteners 20 are mechanical fasteners which include nails, screws (metal screws or wood screws), rivets or other similar devices. Other exemplary fasteners include adhesives such as glue, paste, cement, epoxy and tape, or other connecting devices. In other exemplary embodiments of the invention, it should be understood that legs 18 can be secured to interconnect structure 30 without fasteners 20 or any other securing device.

Still referring to FIG. 1, an exemplary crossbeam 12 includes an elongated and/or linear structure of wood, metal, plastic or similar structure and material. For example, crossbeam 12 includes a 2×4 (two-by-four) piece of lumber that is finished or planed and cut to standardized depth and width. Other exemplary sizes for crossbeam 12 are 1×2, 1×3, 1×4, 1×6, 1×8, 1×10, 1×12, 2×2, 2×3, 2×4, 2×6, 2×8, 2×10, 4×4, 4×6, 4×4, 6×6 and 8×8. Exemplary lengths for crossbeam 12 include ranges of about 1 foot to about 30 feet, such as 4, 6, 8, 10, 12, 14, 16, 18, 20, 22, and 24 feet. An exemplary crossbeam 12 of FIG. 1 is a 2×6 piece of lumber. An exemplary crossbeam 12 has a front side, surface or face 15 opposite a rear side, surface or face 17 (shown in FIG. 3) and a top side or upper surface 16 opposite a bottom side or lower surface 46. The exemplary crossbeam 12 has a pair of opposite ends 13 extending to, or connecting, each one of: the front surface 15, rear surface 17, upper surface 16 and lower surface 46. It should be understood that naming one surface of crossbeam 12 as front instead of rear is arbitrary, and therefore, the naming can be reversed.

In other exemplary embodiments of the invention, it should be understood that other dimensions for crossbeam 12 could be used with an exemplary deciding factor being the job for which supporting apparatus 10 is to be used. Moreover, it should be understood that support apparatus 10, according to various embodiments of the invention, can be used either alone or in combination with one or more support apparatuses 10 to support lumber, drywall, numerous personnel, etc., and any combination thereof at different elevational levels. An exemplary use of a plurality of support apparatuses 10 in a combination includes providing support apparatuses 10 in a stacked manner to form an exemplary scaffolding system. Still other exemplary embodiments of the invention include exemplary support apparatuses 10 having a plurality of crossbeams 12 instead of having only one, for example, two crossbeams, three crossbeams, four crossbeams, and any number of crossbeams up to at least a total of twenty crossbeams, or more.

An exemplary crossbeam 12 includes an elongate and/or linear structure comprising metal or similar material. Exemplary metals or similar material include tin, iron, aluminum, zinc and copper, and alloys of any one metal or any combination of the metals. The metals or similar material can be characterized as being ductile and/or malleable. Being ductile and malleable allows for the metal or similar material to be molded into various forms and hardened. Still other exemplary metals for crossbeam 12 include alloys of metal such as steel, brass and bronze.

Still another exemplary crossbeam 12 includes an elongate and/or linear structure comprising plastic such as thermoplastic, thermosetting plastic and similar material. These plastic materials can be characterized as being ductile and/or malleable which provides the capability of being molded into various forms and hardened. Furthermore, these plastic materials can be generally characterized by any of various nonmetallic compounds, synthetically produced, usually from organic compounds by polymerization, or formed into pliable sheets or films, fibers, flexible or hard foams. Example plastic materials include polystyrene, acrylonitrile butadiene styrene (ABS), polyamide, polypropylene, polyethylene, and polyvinyl chloride (PVC). Other exemplary nonmetallic compounds include spun glass or fiberglass which is a composite of extremely fine fibers of glass combined with polymers and epoxies.

Still referring to FIG. 1, exemplary leg members (legs) 18 can include elongate wood, metal or plastic materials including all the various materials, and combinations thereof, described above for crossbeam 12. For example, legs 18 can be 2×4 (two-by-four) pieces of lumber. However, it should be understood that other dimensions for legs 18 could be used, including all the dimensions described above for crossbeam 12. The dimensions of openings (described below) of interconnect structures 30 are formed or modified (or dimensioned) to accommodate receipt of end portions of the selected legs 18. Alternatively, the dimensions of the end portions of the selected legs 18 are selected or modified (or dimensioned) to accommodate maneuvering the end portions of the selected legs 18 into the openings of interconnect structures 30.

Moreover, it should be understood that any various combinations of different dimensions and materials for respective legs 18 can be used with respect to any of the various combinations of different dimensions and materials for crossbeam 12. Additionally, one pair of legs 18 could have the same dimensions and/or the same materials with either the dimension or material, or both, being different from the dimensions and/or materials of the other pair of legs 18. Alternatively, each one leg 18 can have a different dimension and/or different material relative each other leg 18 for a single one of the pair of legs, or any various combinations thereof.

In one exemplary embodiment of the invention, an exemplary support apparatus 10 includes each leg 18, including a plurality of elongated and/or linear leg structures 18, being provided in one opening (described below) of interconnect structures 30. For example, a plurality of leg structures 18, ranging from at least one to about 5, or more, can be provided in one opening of interconnect structures 30. In one exemplary embodiment, each one of the plurality of elongated leg structures 18 are positioned side-by-side (each side of a side-by-side is the two opposite planar sides of legs 18 having the greatest surface area, that is, the front side and the rear side of leg 18).

Figure 2:
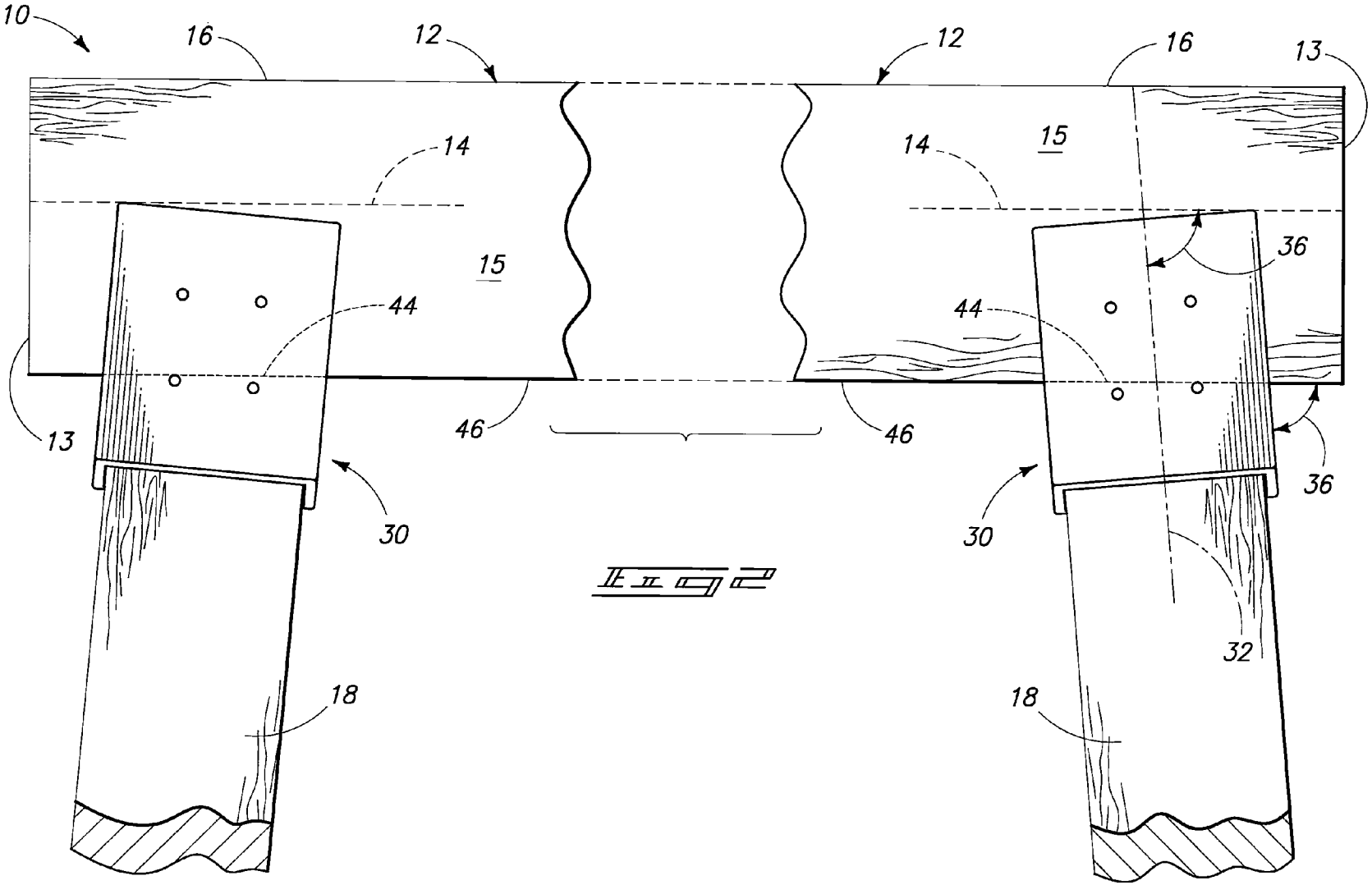
FIG. 2 is a partial front side view of the support apparatus illustrated in FIG. 1.

Referring to FIG. 2, an exemplary orientation of interconnect structures or brackets 30 is illustrated relative crossbeam 12 and legs 18 according to one of various embodiments of the invention. This exemplary embodiment has a pair of interconnect structures 30 with each one located proximate an end 13 of crossbeam 12. Each interconnect structure 30 can be positioned at end 13, and alternatively, each can be spaced a distance from end 13 as illustrated. For example, interconnect structure 30 can be spaced less than a distance of one inch from end 13. Additionally, interconnect structure 30 can be spaced one inch from end 13. Furthermore, interconnect structure 30 can be spaced from end 13 for any one value in a range of distances from end 13 that include less than about 1 inch to about 132 inches or more (with the understanding that crossbeam 12 is long enough lengthwise to accommodate such spacing of interconnect structures 30).

Moreover, it should be understood that any number of interconnect structures 30 can be provided for a single crossbeam 12. For example, a range of two to about 20 or more interconnect structures 30 can be provided for the crossbeam 12, particularly including 3, 4, 5, 6, 7, 8, 9, 10 interconnect structures 30. Still further, exemplary respective spacing distances between each interconnect structure 30 along the longitudinal length of the crossbeam 12 can be substantially the same or varied. Furthermore, each exemplary interconnect structure 30 can be positioned at any location relative the longitudinal length of the crossbeam 12.

Figure 17:
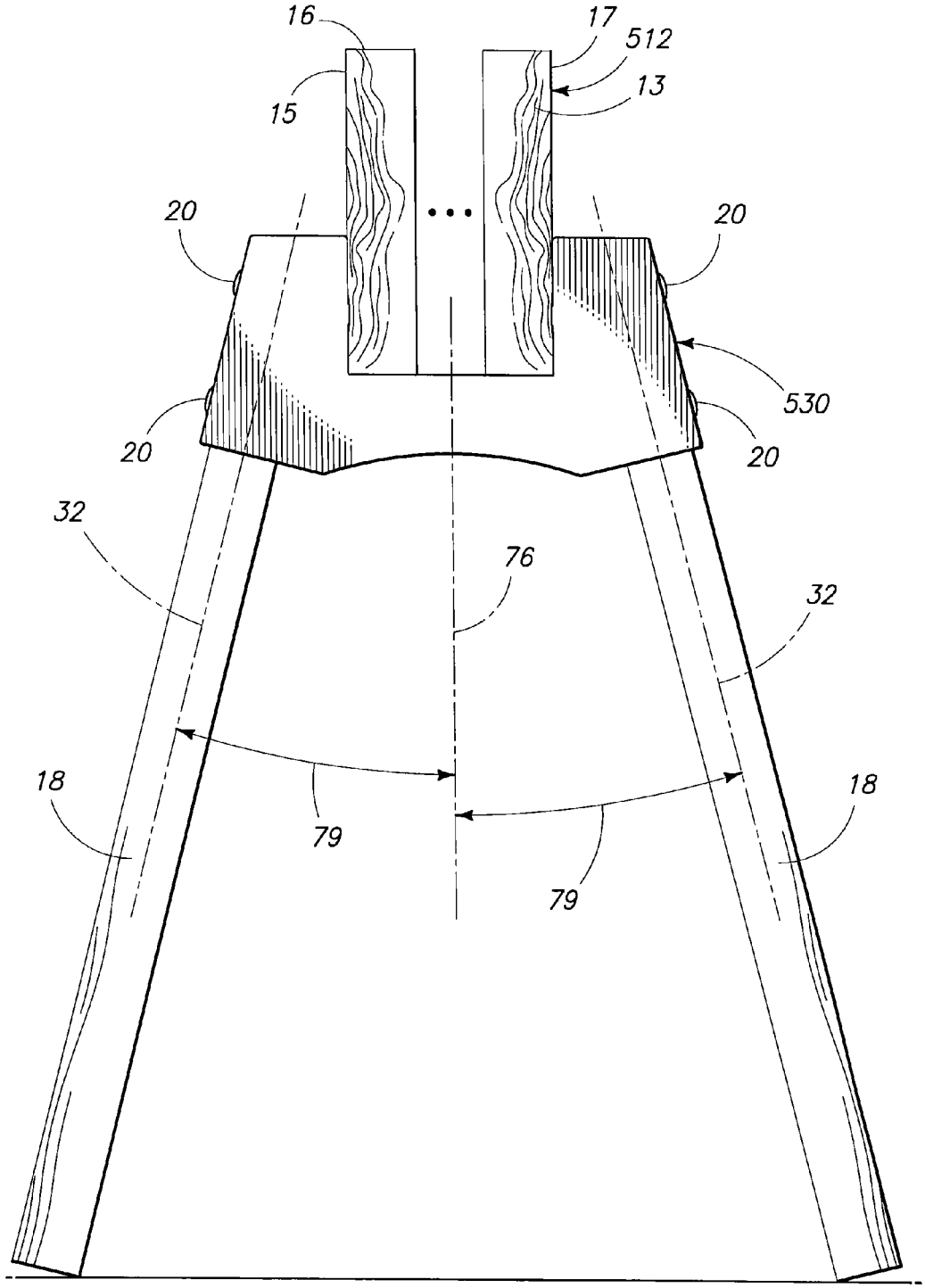
FIG. 17 is an end view of an embodiment of the invention including a crossbeam having a plurality of elongated, linear structures.

In one exemplary embodiment of the invention, an exemplary support apparatus 10 includes a crossbeam 512 having a plurality of elongated and/or linear structures (see FIG. 17) (please note, interconnect structure 530 will have different dimensions than the other interconnect structures described below (some referenced as 30) to accommodate the plurality of elongated and/or linear structures). For example, an exemplary crossbeam 512 includes a number of elongated and/or linear structures ranging from at least one to about 20 or more elongated structures. In one exemplary embodiment, each one of the plurality of elongated structures for crossbeam 512 are positioned side by side in general alignment. Side-by-side positioning includes a relationship with a rear surface 17 or front surface 15 of one elongated structure facing, or proximate, or against at least a portion of a rear surface 17 or front surface 15 of at least one other elongated structure.

It should be understood that for a side-by-side positioning, orientation of respective elongated structures can be greatly varied for different embodiments. For example, an orientation of a pair of elongated structures can include at least one pair of respective ends 13 in substantially a coextensive, planar relationship (that is, respective ends are aligned in a plane side by side). Alternatively, another exemplary orientation of a pair of elongated structures in a side-by-side positioning can include at least one pair of respective ends 13 in substantially a spaced relationship (that is, respective ends are not aligned in a plane side by side). In this orientation, the spacing distance between respective ends 13 can range from 0 inch (that is in a coextensive, planar relationship) to a distance equaling the length of the elongated structure (approximating an end-to-end position discussed below).

In another exemplary embodiment of the invention, an exemplary support apparatus 10 includes a crossbeam 12 having a plurality of elongated structures positioned in an end-to-end relationship. End-to-end positioning includes a relationship that has an end 13 of at least one elongated structure facing, or proximate, or against an end 13 of at least one other elongated structure. For this end-to-end positioning, each of the two adjacent ends 13 of respective elongated structures are positioned in a channel 60 of a single interconnect structure 30 (discussed more thoroughly subsequently).

Still another exemplary embodiment of the invention, an exemplary support apparatus 10 includes a crossbeam 12 having a plurality of elongated structures in any number of combinations of end-to-end positions and/or side-by-side positions. For example, at least one pair of elongated structures is in an end-to-end position and at least one other elongated structure is in a side-by-side position with at least one of the pair of the structures in the end-to-end position (accordingly, a total of at least three elongated structures in this one example). Yet another exemplary embodiment of a crossbeam 12 includes having a first set of a plurality of elongated structures in side-by-side positions and a second set of a plurality of elongated structures in side-by-side positions wherein the first set is in end-to-end positions with the second set.

Still referring to FIG. 2, each interconnect structure 30 has a receiving surface 44 (illustrated as dashed lines) to support or receive a portion of the lower surface 46 of crossbeam 12. Axis 14 represents a longitudinal axis 14 of crossbeam 12. In one exemplary embodiment of the invention, longitudinal axis 14 is substantially horizontal. Moreover, longitudinal axis 14 is substantially parallel with lower longitudinal surface 46 of crossbeam 12. Axis 32 represents a longitudinal axis 32 of legs 18 (only shown for one leg 18). In one exemplary embodiment of the invention, longitudinal axis 32 is angled toward the end 13 of crossbeam 12, and therefore, legs 18 are angled or positioned outwardly toward the end 13 of crossbeam 12. Alternatively stated, from this view of support apparatus 10, legs 18 are angled away from a center of gravity for crossbeam 12. Angle 36 represents the angle between longitudinal axis 14 of crossbeam 12 and longitudinal axis 32 of leg 18. Notably, for this exemplary embodiment, angle 36 represents an angle value of less than 90°, and therefore, is not a vertical axis relative the exemplary horizontal longitudinal axis 14.

For various embodiments of the invention, angle 36 between longitudinal axis 14 of crossbeam 12 and longitudinal axis 32 of leg 18 represents ranges of possible values of degrees. For example, angle 36 can represent any one angle value in a range of values, for example, from about 1 degree to about 89 degrees. Other exemplary ranges for angle 36 include about: 81 degrees to about 89 degrees; about 82 degrees to about 89 degrees; about 82 degrees to about 88 degrees; about 82 degrees to about 87 degrees; about 82 degrees to about 86 degrees; about 82 degrees to about 85 degrees; about 82 degrees to about 84 degrees; about 82 degrees to about 83 degrees; about 83 degrees to about 89 degrees; about 83 degrees to about 88 degrees; and about 83 degrees to about 87 degrees. An exemplary angle 36 includes about 85 degrees. It should be understood that this angle 36 increases the stability of the inventive support apparatuses 10 and increases the maximum load support apparatus 10 can safely handle. Accordingly, angle 36 increases safety, facility of use, versatility and handling of heavy loads by support apparatuses 10 over prior art support apparatuses.

Figure 3:
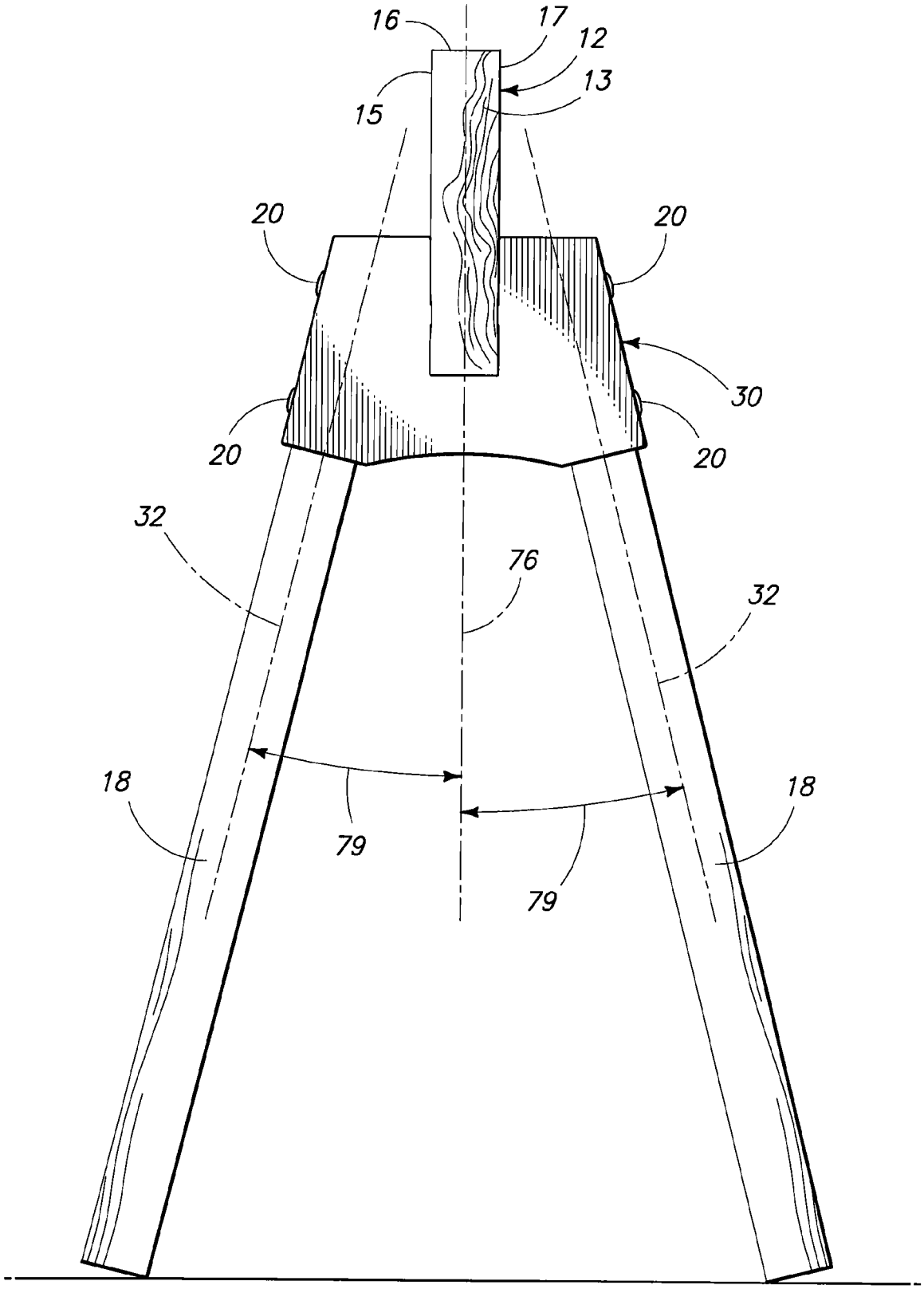
FIG. 3 is an end view of the support apparatus illustrated in FIG. 1.

Referring to FIG. 3, a side view of the exemplary support apparatus according an embodiment of the invention is illustrated. A vertical axis 76 is shown extending through generally the center of end 13 of crossbeam and generally through the center of interconnect structure 30. The longitudinal axes 32 of legs 18 are illustrated extending through generally the center of legs 18 and represent the same longitudinal axes 32 as described and shown in FIG. 2, but from the side view of legs 18. From this side view, it can be seen that legs 18 are divergently angled 79, that is, angled laterally outwardly from the vertical axis 76. It should be understood that this angle 79 increases the stability of the inventive support apparatus and increases the maximum load support apparatus 10 can safely handle. Accordingly, angle 36 increases safety, facility of use, versatility and handling of heavy loads by support apparatuses 10 over prior art support apparatuses. In one exemplary embodiment of the invention, an exemplary angle 79 is 14°. For other embodiments of the invention, angle 79 is any value of degree in a range of values, for example, a range including about 1° to about 45°, or about 10° to about 18°, and which includes values of about 10°, 11°, 12°, 13°, 15°, 16°, 17°, 18° and 20°.

Figure 4:
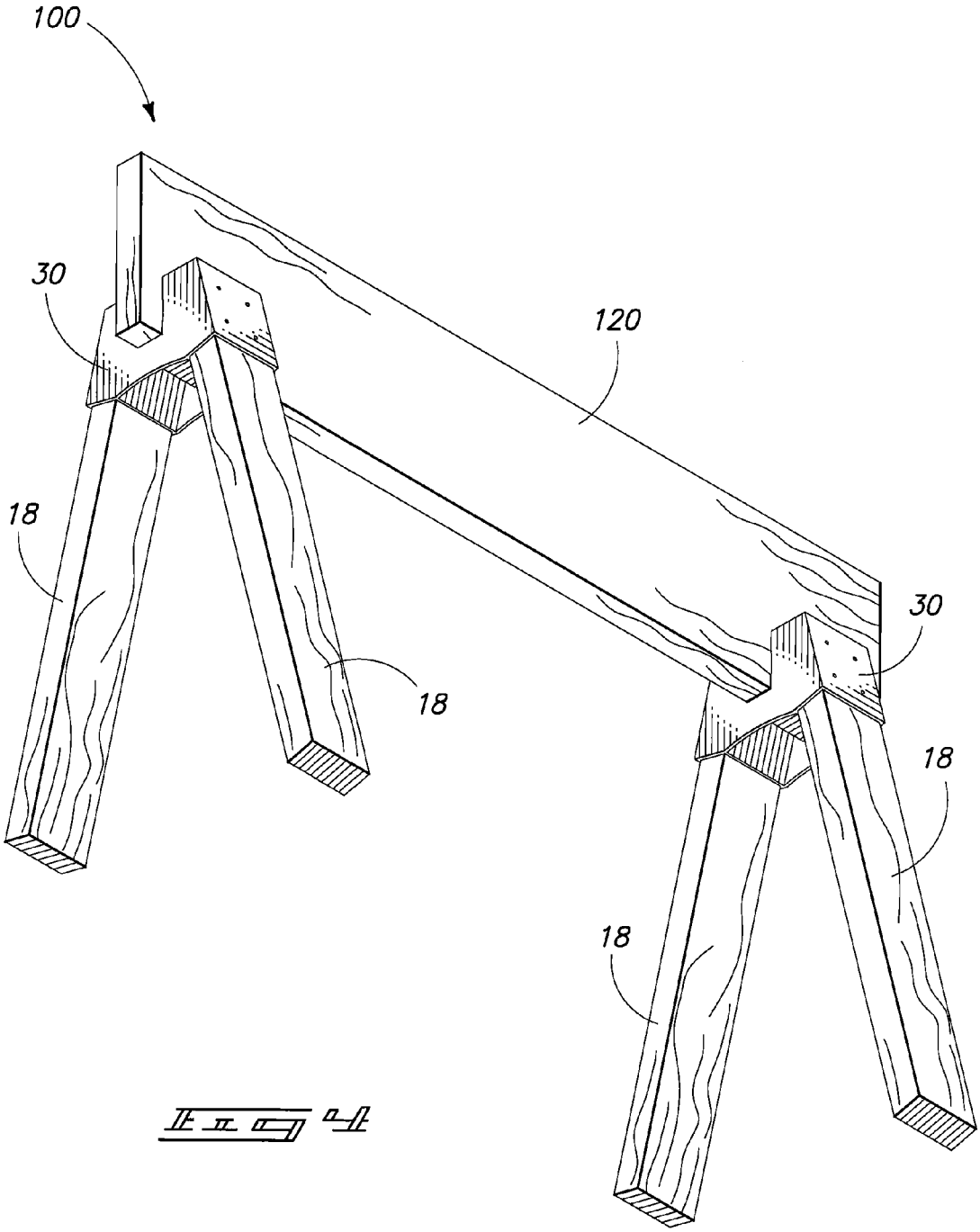
FIG. 4 is a perspective view of another support apparatus according to another of the various embodiments of the invention.

Referring to FIG. 4, another exemplary support apparatus 100 according to another embodiment of the invention is illustrated. An exemplary crossbeam 120 for support apparatus 100 is a 2×10 piece of lumber. However, it should be understood that crossbeam 120 can have any of the various materials and dimensions described above with respect to crossbeam 12.

Referring to FIGS. 5-8, a more thorough description of one embodiment of the interconnect structure 30 is described according to exemplary embodiments of the invention. It should be understood that exemplary materials for interconnect structure 30 include wood, metal, plastic materials and various combinations of each, including all the various materials and combinations described previously with respect to crossbeam 12. For one exemplary embodiment of the invention, interconnect structure 30 is an integrally formed as a single die-cast structure, for example, a one piece, compact, die-cast aluminum structure, described more thoroughly subsequently.

Figure 5:
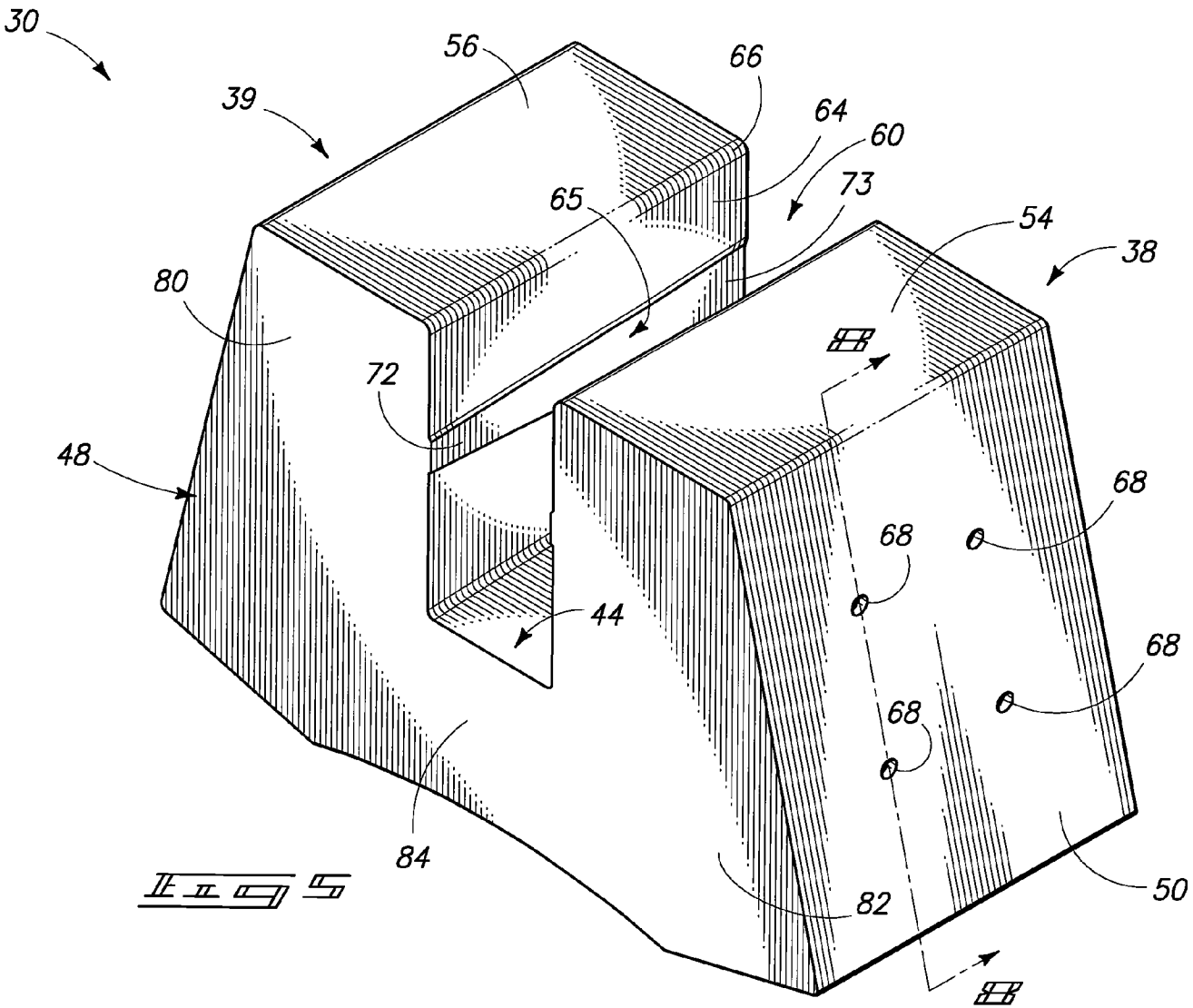
FIG. 5 is a perspective view of an interconnect structure according to one of various embodiments of the invention.
Figure 6:
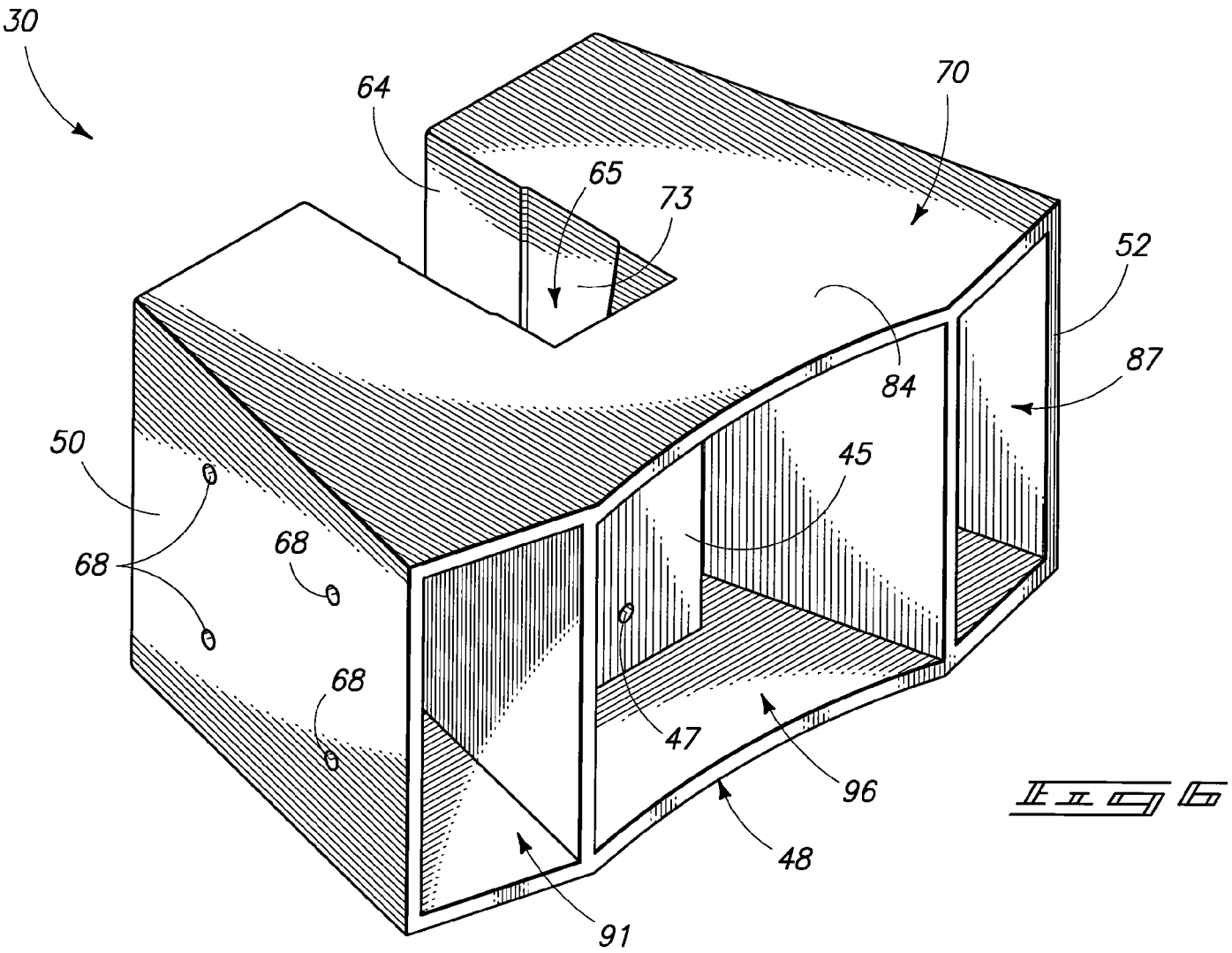
FIG. 6 is a bottom, perspective view of the interconnect structure illustrated in FIG. 5.

Referring to FIGS. 5-6, a general configuration of an exemplary interconnect structure 30 is a rectangular box having one open side opposite a channel 60. Alternatively stated, the general configuration of an exemplary interconnect structure 30 is two boxes or receptacles 38 and 39 spaced apart by channel 60. Furthermore, each receptacle 38 and 39 is joined together by the receiving surface 44 of channel 60 and joined by a central section 84 of respective walls 48 and 70 (described subsequently). Each receptacle 38 and 39 is configured and dimensioned substantially the same. It should be understood that each receptacle 38 and 39 has a cavity 91 and cavity 87, respectively, which receive legs 18.

The box configuration allows for a compact design for interconnect structure 30 which facilitates the ease and speed of which interconnect structure 30 can be used to form, and break down, an exemplary support apparatuses 10 with consistency. Moreover, exterior walls for an exemplary interconnect structure 30 are planar which facilitates the ease and speed of which interconnect structure 30 can be used to form, and break down, an exemplary support apparatuses 10 with consistency.

In fact, the configuration of an exemplary interconnect structure substantially comprises an isosceles trapezoid box or a three-dimensional isosceles trapezoid. The interconnect structure 30 has a front wall 48 opposite a rear wall 70. Each one wall (front wall 48 and rear wall 70) is configured generally as a isosceles trapezoid having channel 60 extending along the axis of symmetry. That is, the two opposite edges that are parallel have one parallel edge being interrupted by channel 60, and the other two opposite edges which are not parallel diverge outwardly (from respective upper surfaces 54 and 56) and have equal lengths. The smaller of the two parallel edges is interrupted by the channel 60. Moreover, the larger of the two parallel edges forms a periphery portion of the open side of the interconnect structure 30. The front wall 48 is connected to the rear wall 70 by additional planar walls discussed below, and alternatively stated, the two isosceles trapezoid walls 48 and 70 are connected by the additional planer walls.

Still referring to FIGS. 5-6, interconnect structure 30 includes the front wall 48 (front side or front face) opposite the back wall 70 (back side or back face). In one embodiment of the invention, front wall 48 is configured and dimensioned similar to back wall 70. Each wall 48 and 70 has a first end section 80 laterally spaced from a second end section 82 by channel 60 and joined at central section 84. Each first end section 80 is configured and dimensioned similar to each second end section 82. Moreover, each first end section 80 is substantially coplanar with each second end section 82. It should be understood that each wall 48, 70 is a single coplanar structure that includes respective end sections 80 and 82 extending from respective central sections 84.

Additionally, it should be understood that for one embodiment of the invention, front wall 48 is substantially parallel with back wall 70 and each has substantially the same thicknesses. An exemplary thickness for walls 48, 70 is about 4.8 mm±1.0 mm (~0.189 inch±0.0394 inch). In other embodiments of the invention, thicknesses for walls 48, 70 can include a range of thicknesses such as increments of 0.5 mm in a range of about 1.5 mm to about 10 mm±1.0 mm. Further, it should be understood that exemplary materials for walls 48, 70 include wood, metal or plastic materials and include all the various materials and combinations thereof described above for crossbeam 12. One exemplary embodiment of the invention, walls 48, 70 comprise aluminum. Moreover, it should be further understood that interconnect structure 30 is machined with low tolerances, particularly when considered in the context of prior art apparatuses and devices. Consequently, the inventive interconnect structures 30 of this application provides snug and tight fits for legs 18 and crossbeams 12 which provide for a very stable support apparatuses 10 to increase safety, versatility and capabilities to handle heavy loads over prior art support apparatuses.

Referring to FIG. 5, interconnect structure 30 further includes a pair of upper surfaces: a first upper surface 54 and a second upper surface 56 extending to and between respective walls 48, 70. Each upper surface 54, 56 is configured and dimensioned similar to each other and each is coplanar relative to the other. In one embodiment of the invention, each upper surface 54, 56 is substantially rectangular and each intersects respective walls 48, 70 at substantially right angles (that is, substantially perpendicularly (90°)). An exemplary thickness for upper surfaces 54, 56 is about 4.8 mm±1.0 mm (~0.189 inch±0.0394 inch). In other embodiments of the invention, thicknesses for upper surfaces 54, 56 can include a range of thicknesses such as increments of 0.5 mm in a range of about 1.5 mm to about 10 mm±1.0 mm. Further, it should be understood that exemplary materials for upper surfaces 54, 56 include wood, metal or plastic materials and include all the various materials and combinations thereof described above for crossbeam 12. One exemplary embodiment of the invention, upper surfaces 54, 56 comprise aluminum.

Still referring to FIGS. 5-6, interconnect structure 30 has the channel 60 (canal or passageway) centrally located therein and extending partially through the interconnect structure 30 from respective upper surfaces 54, 56. Each upper surface 54, 56 extends to respective walls of channel 60. For example, first upper surface 54 extends to a first channel wall 62 (see FIG. 5) and second upper surface 56 extends to a second channel wall 64. Each upper surface 54, 56 intersects respective channel walls 62, 64 to form an arcuate corner 66 (curved, rounded or arched). It should be understood that channel 60 receives a portion of crossbeam 12 wherein corners 66 facilitate receipt of crossbeam 12 in channel 60.

Furthermore, in one embodiment of interconnect structure 30, it should be understood that an upper region of channel 60 proximate upper surfaces 54, 56 is larger than a lower region of channel 60 proximate receiving surface 44. Stated another way, channel walls 62, 64 are not parallel. That is, the spacing between upper sections of respective channel walls 62, 64 proximate upper surfaces 54, 56 is greater than the spacing between lower sections of respective channel walls 62, 64 proximate receiving surface 44. Accordingly, each channel wall 62, 64 is angled from each upper surface 54, 56 wherein each channel wall extends toward each other as each extends downward and toward receiving surface 44. This spacing differential of the channel walls 62, 64 facilitates receipt of crossbeam 12 in channel 60. For another embodiment of interconnect structure 30, channel walls 62, 64 are parallel, and therefore, there is no spacing differential between respective channel walls 62 and 64.

For one exemplary embodiment of the invention, an exemplary thickness for channel walls 62, 64 is about 4.8 mm±1.0 mm (~0.189 inch±0.0394 inch). In other embodiments of the invention, thicknesses for respective channel walls 62, 64 can include a range of thicknesses such as increments of 0.5 mm in a range of about 1.5 mm to about 10 mm±1.0 mm. Further, it should be understood that exemplary materials for respective channel walls 62, 64 include wood, metal or plastic materials and include all the various materials and combinations thereof described previously with respect to crossbeam 12. For one exemplary embodiment of the invention, respective channel walls 62, 64 comprise aluminum.

Still referring to FIG. 5, it should be understood that channel 60 terminates at the receiving surface 44 elevationally above central sections 84 of front wall 48 and back wall 70, respectively. It should be further understood that a portion of crossbeam 12 is provided in channel 60 wherein a portion of the lower surface 46 of crossbeam 12 is supported over or on receiving surface 44 of interconnect structure 30. For one exemplary embodiment of the invention, an exemplary thickness for receiving surface 44 is about 4.8 mm±1.0 mm (~0.189 inch±0.0394 inch). In other embodiments of the invention, thicknesses for receiving surface 44 can include a range of thicknesses such as increments of 0.5 mm in a range of about 1.5 mm to about 10 mm±1.0 mm. Further, it should be understood that exemplary materials for receiving surface 44 include wood, metal or plastic materials and include all the various materials and combinations thereof described previously with respect to crossbeam 12. For one exemplary embodiment of the invention, receiving surface 44 comprises aluminum.

Still referring to FIGS. 5-6, interconnect structure 30 further includes a pair of sidewalls, a first sidewall 50 opposite a second sidewall 52. Each sidewall 50, 52 is configured and dimensioned similar to each other. First sidewall 50 extends downwardly at an angle from first upper surface 54 and second sidewall 52 extends downwardly at an angle from second upper surface 56. Each sidewall 50 and 52 diverge outwardly as each extends from respective upper surfaces 54 and 56. That is, there is spacing between respective sidewalls 50, 52 which increases as each extends downwardly from respective upper surfaces 54, 56. Openings 68 are formed in respective sidewalls 50, 52 to receive fasteners 20 for securing legs 18 to interconnect structure 30. It should be understood any number of openings 68 can be provided in respective sidewalls 50 and 52 including zero, and includes at least a range of about 0 openings to about 20 openings. In one exemplary embodiment of the invention, four openings 68 are provided in respective sidewalls 50, 52.

Still referring to FIGS. 5-6, the first and second sidewalls 50, 52 extend from opposite edges of respective upper surfaces 54, 56 at an angle greater than 90°. For exemplary embodiments of the invention, respective sidewalls 50, 52 intersect (or extend from) respective upper surfaces 54, 56 for a range of possible angles of about 45° to about 135° and including all angle of increments of 10 in between. For one exemplary embodiment of the invention, respective sidewalls 50, 52 intersect (or extend from) respective upper surfaces 54, 56 at an angle of about 104°. For this exemplary embodiment, first sidewall 50 establishes an angle of about 118° relative to the second sidewall 52. For other exemplary embodiments of the invention, first sidewall 50 establishes a range of possible angles relative to the second sidewall 52 such as any degree of angle in a range of about 110° to about 130°.

For one exemplary embodiment of the invention, an exemplary thickness for respective sidewalls 50, 52 is about 4.8 mm 1.0 mm (~0.189 inch±0.0394 inch). In other embodiments of the invention, thicknesses for respective sidewalls 50, 52 can include a range of thicknesses such as increments of 0.5 mm for a range of about 1.5 mm to about 10 mm±1.0 mm. Further, it should be understood that exemplary materials for respective sidewalls 50, 52 include wood, metal or plastic materials and include all the various materials and combinations thereof described previously with respect to crossbeam 12. For one exemplary embodiment of the invention, respective sidewalls 50, 52 comprise aluminum.

Figure 7:
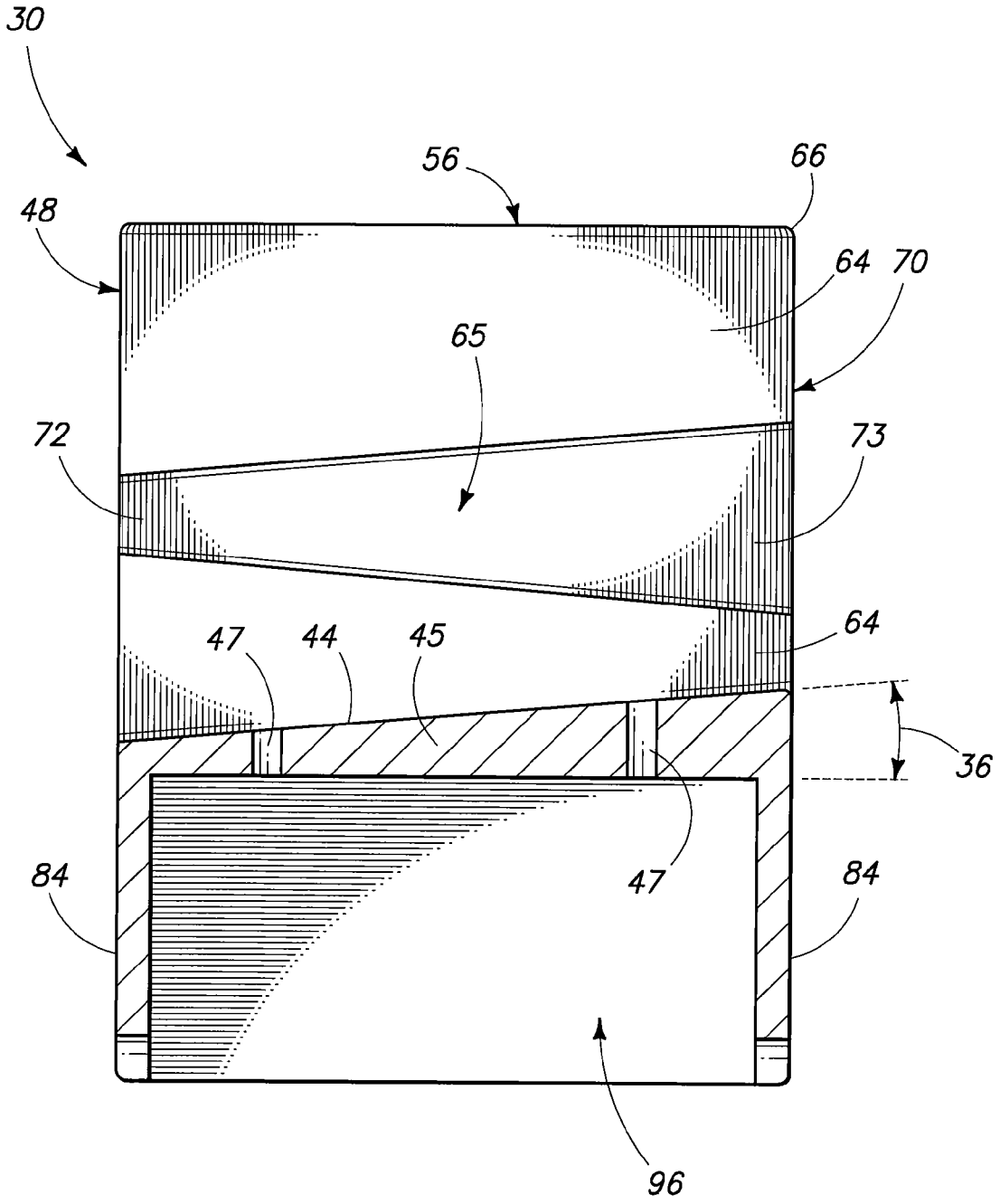
FIG. 7 is a cross-sectional side view of the interconnect structure illustrated in FIG. 5 taken through a center of a channel.

Still referring to FIGS. 5-7, interconnect structure 30 further includes a retainer (or retaining) element 65 in at least one of respective channel walls 62 and 64 of channel 60. In one exemplary embodiment of the invention, a retainer element 65 is formed in both channel walls 62 and 64. In still another exemplary embodiment of the invention, a plurality of retainer elements 65 is formed in at least one channel wall 62, 64. An exemplary retainer element 65 extends the length of channel 60 from front wall 48 to back wall 70. Particularly referring to FIG. 7 and for one exemplary embodiment of the invention, retainer element 65 is configured in a trapezoid shape. Other exemplary embodiments of the invention, retainer element 65 can be configured in other geometric shapes, for example, a rectangle, parallelogram and triangle to name only a few possibilities.

Still referring to FIGS. 5-7, and in one exemplary embodiment of the invention, a portion of retainer element 65 proximate front wall 48 is a ridge 72 extending outwardly from respective channel walls 62, 64 into channel 60. In this exemplary embodiment, a portion of retainer element 65 proximate back wall 70 is a recess 73 extending inwardly from respective channel walls 62, 64 away from channel 60 (and toward respective sidewalls 50, 52). Accordingly, moving from the front wall 48 along the retainer element 65, the retainer element 65 is configured as a ridge extending as a height extension from the channel walls 62, 64 into channel 60. As the retainer element 65 extends toward the opposite back wall 70, the retainer element 65 (ridge) continually diminishes in height extension from the channel walls 62, 64 until retainer element 65 transitions into recess 73 in respective channel walls 62 and 64.

Still referring to FIGS. 5-7, and considering a position located at an exemplary distance from front wall 48 along the channel walls 62 and 64, the retainer element 65 is coplanar with the channel walls 62, 64. An exemplary distance from front wall 48 along the channel walls 62, 64 wherein this coplanar configuration is established is approximately half the distance between the front and back walls 48 and 70. At this position, there is no height extension of retainer element 65 from the channel walls 62, 64. As the retainer element 65 extends from this half-way point toward the back wall 70, the retainer element 65 increases in distance away from the channel 60 and toward respective sidewalls 50, 52. That is, the depth of recess 73 is increased. For other embodiments of the invention, the position where the retainer element 65 is coplanar with the channel walls 62, 64 can be other than the half-way distance just described. In one example, the position where the retainer element 65 is coplanar with the channel walls 62, 64 is more proximate the front wall 48, and alternatively, more proximate the back wall 70. It should be understood that retainer members 65 facilitate holding crossbeam 12 within channel 60.

In another embodiment of the invention, an entirety of retainer element 65 is a ridge with a height dimension extending outwardly from the channel walls 62, 64. That is, as the retainer element 65 extends between front wall 48 and back wall 70, retainer element 65 forms no recess portion. In still another embodiment of the invention, an entirety of retainer element 65 is a recess extending inwardly from the channel walls 62, 64 towards the sidewalls 50, 52. That is, as the retainer element 65 extends between front wall 48 and back wall 70, retainer element 65 forms no ridge portion with a height dimension. In yet another embodiment of the invention, only one of the channel walls has a retainer element 65, either the first channel wall 62 or the second channel wall 64. In other embodiments of the invention, one channel wall can have one configuration of a retainer element 65 discussed above while the other channel wall has a different configuration of a retainer element 65. For example, one channel wall can have a retainer element configured entirely as a ridge while the other channel wall has a retainer element configured entirely as a recess, or configured as a combination of the recess and the ridge. Alternatively, each channel wall can have the same configuration for the retainer element 65.

Figure 8:
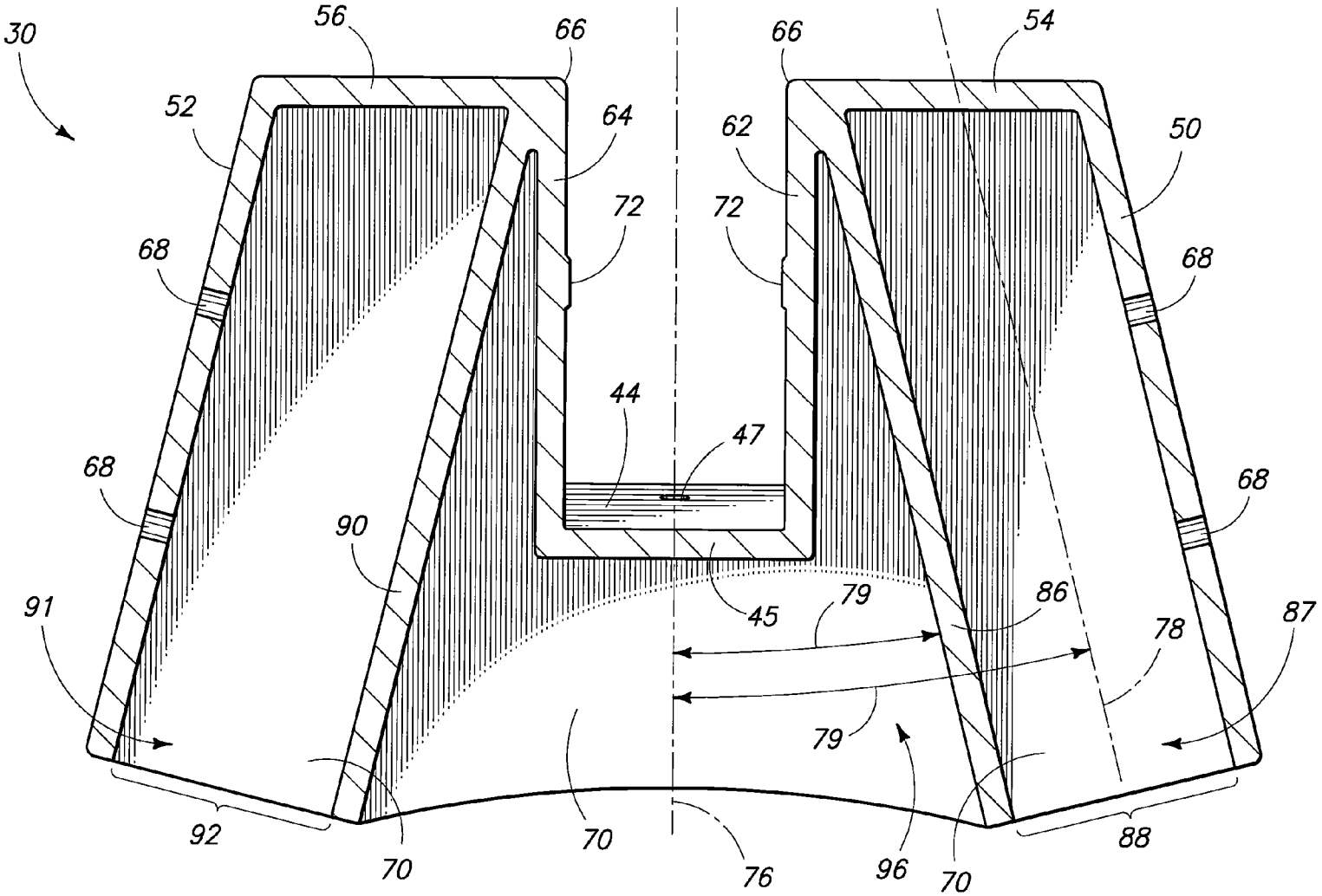
FIG. 8 is a cross-sectional front view of the interconnect structure illustrated in FIG. 5.

Referring to FIG. 6 and FIG. 8, an exemplary interconnect structure 30 includes a plurality of cavities. A first inner wall 86 is formed spaced from and generally parallel with first sidewall 50 leaving a first cavity 87 and a first ingress 88 to the first cavity 87. A second inner wall 90 is formed spaced from and generally parallel with second sidewall 52 leaving a second cavity 91 and a second ingress 92 to the second cavity 91. It should be understood that respective cavities 87, 91 will receive respective end portions of legs 18 therein through respective ingresses 88, 92. It should be further understood that respective inner walls 86, 90 extend between front wall 48 and back wall 70 and extend to (or from) respective arcuate corners 66 of respective upper surfaces 54, 56 and respective channel walls 62, 64. The respective inner walls 86, 90 leave a central cavity 96 of interconnect structure 30 beneath receiving surface 44 and in between the central sections 84 of respective walls 48 and 70.

For one exemplary embodiment of the invention, an exemplary thickness for respective inner walls 86, 90 is about 4.8 mm±1.0 mm (~0.189 inch±0.0394 inch). In other embodiments of the invention, thicknesses for respective inner walls 86, 90 can include a range of thicknesses such as increments of about 0.5 mm in a range of about 1.5 mm to about 10 mm±1.0 mm. Further, it should be understood that exemplary materials for respective inner walls 86, 90 include wood, metal or plastic materials and include all the various materials and combinations thereof described previously with respect to crossbeam 12. For one exemplary embodiment of the invention, respective inner walls 86, 90 comprise aluminum.

Interconnect structures 30 according to various embodiments of the invention are machined with low tolerances to configure respective cavities 87, 91 to receive respective legs 18 in a tight and snug fit. The tight and snug fit of legs 18 in interconnect structure 30 provides a very stable support apparatuses 10 even without fasteners 20. Accordingly, each cavity 87, 91 is dimensioned with low tolerances to receive any selected or chosen size for a leg member. Moreover, dimensions for respective cavities 87, 91 can include a range of dimensions measured between respective inner walls and respective sidewalls such as increments of 1.0 mm in a range of about 20 mm to about 60 mm±1.0 mm. For one exemplary embodiment of the invention, a dimension measured between respective inner walls and respective sidewalls is about 39 mm±1.0 mm. Further, dimensions for respective cavities 87, 91 can include a range of dimensions measured between the front wall and the back wall such as increments of 2.0 mm in a range of about 60 mm to about 120 mm±1.5 mm. For one exemplary embodiment of the invention, a dimension measured between the front wall and the back wall is about 90 mm±1.5 mm.

Referring to FIG. 7, interconnect structure 30 includes a receiving wall 45 that forms the receiving surface 44 which receives the crossbeam 12 thereon. A pair of openings 47 extends through receiving wall 45. Openings 47 are provided to receive fasteners (not shown) for securing crossbeam 12 within channel 60 and to receiving surface 44. Exemplary fasteners for openings 47 include mechanical fasteners which include nails, screws (metal screws or wood screws), rivets or other similar devices. Other exemplary fasteners include adhesives such as glue, paste, cement, epoxy and tape, or other connecting devices. While only two openings 47 are shown, in other embodiments of the invention, no openings are provided, or one opening is provided, or more than two openings are provided with a range of about three openings to about eight openings.

Still referring to FIG. 7, an exemplary receiving wall 45 has a greater thickness proximate back wall 70 than the thickness of receiving wall 45 proximate front wall 48. As stated previously, lower surface 46 of crossbeam 12 will be positioned over or directly against (or contacting) receiving surface 44 of interconnect structure 30 in a parallel relationship. In one embodiment of the invention, receiving surface 44 and lower surface 46 of crossbeam 12 will be oriented horizontally leaving the legs 18 angled relative the horizontal surface. In fact, the thickness differential in the thicknesses of receiving wall 45 will provide angle 36 discussed previously with regard to FIG. 2. It should be understood that the greater thickness of receiving wall 45 can be proximate front wall 48 instead of back wall 70. In other embodiments of the invention, the thickness differential in the thicknesses of receiving wall 45 can be larger or smaller than disclosed thereby forming an angle represented as angle 36 (disclosed as approximating 50) to be larger or smaller, respectively, than the disclosed angle 36.

As stated, exemplary embodiments of the invention include the interconnect structure 30 as being a single piece structure, die-cast structure, for example, which allows interconnect structure 30 to be compact. In fact, an exemplary interconnect structure 30 has a maximum volume of approximately 2,600 $cm^3$ (centimeters cubed) wherein the volume is configured substantially as a rectangular box. This structural design facilitates and reinforces strength and sturdiness in the interconnect structure 30 which when used in the inventive support apparatus of this application, increases safety, stability and versatility for the support apparatuses to handle heavy loads over the prior art sawhorses.

Exemplary methods of forming exemplary embodiments of interconnect structure 30 are describe according to various embodiments of the invention. One exemplary method of forming an interconnect structure 30 is by injection molding. Injection molding is a manufacturing process using thermoplastic and/or thermosetting plastic materials described previously in which to form the interconnect structure 30 (example plastic materials include polystyrene, acrylonitrile butadiene styrene (ABS), polyamide, polypropylene, polyethylene, and polyvinyl chloride (PVC)). An overview of an injection molding process includes molten plastic being injected at high pressure into a mold wherein the mold is an inverse design of the shape of the interconnect structure 30.

Another exemplary method of forming an interconnect structure 30 according to various embodiments of the invention is by die casting. Die casting is a manufacturing process using metals and/or metal alloys described previously in which to form the interconnect structure 30 (example metals or metal alloys include tin, iron, aluminum, zinc and copper, and alloys of any one metal or any combination of the metals.). An overview of a die casting process includes molten metal being injected at high pressure into a mold wherein the mold is an inverse design of the shape of the interconnect structure 30. Still other exemplary methods of forming an interconnect structure 30 according to embodiments of the invention include: permanent mold casting, extrusion, forging, sand casting, powder metallurgy, ceramic mold casting, plaster mold casting and centrifugal casting.

A more thorough description of an exemplary method 290 for forming an exemplary interconnect structure 30 is presented by referring to FIGS. 9-16. The following description of method 290 is applicable to the above-referenced methods.

Figure 9:
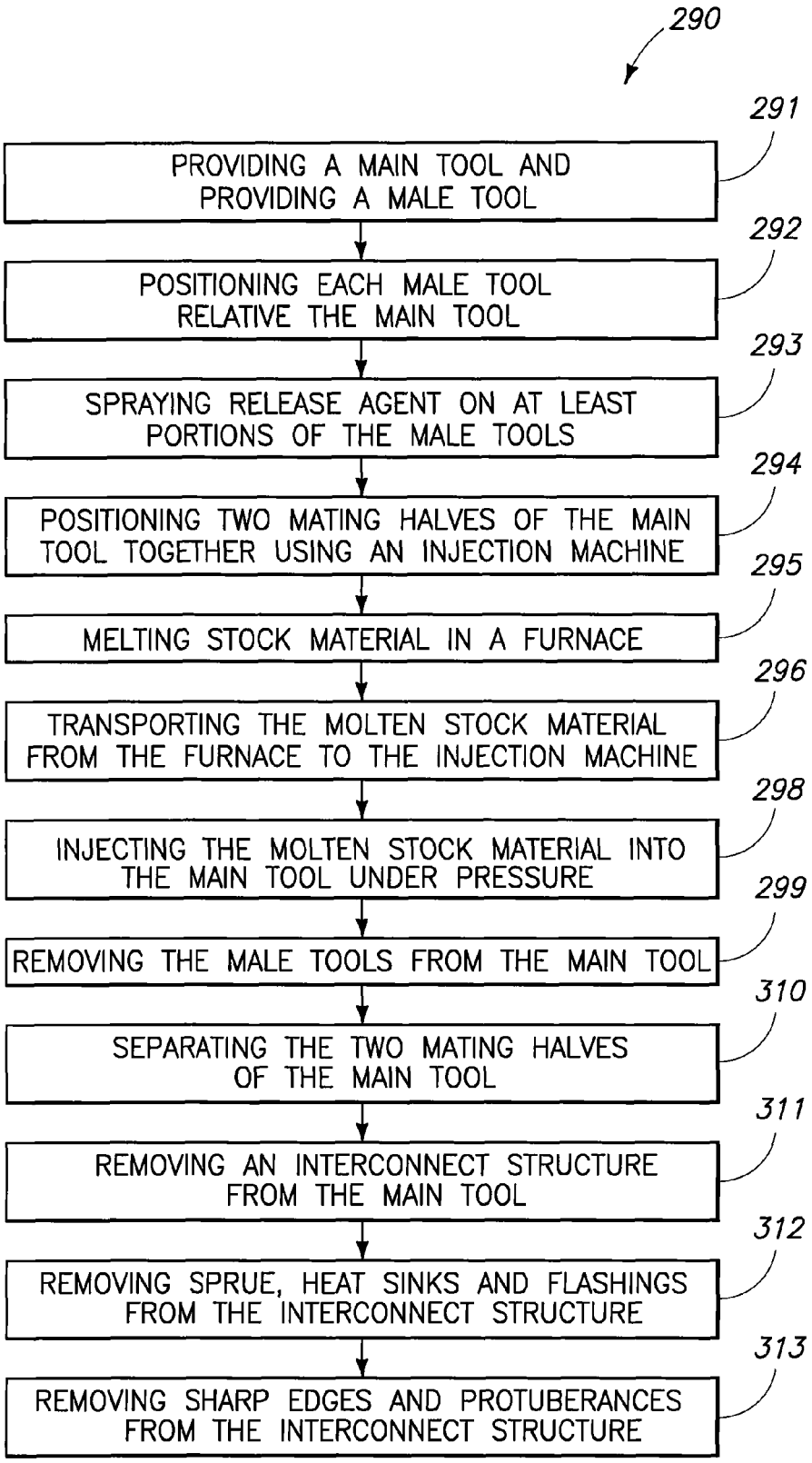
FIG. 9 is an exemplary method for forming an interconnect structure according to one of various embodiments of the invention.

Referring to FIG. 9, an exemplary step 291 of method 290 includes providing a main (or female) tool and providing at least one male (or interior) tool. For one embodiment of the invention, two male tools are provided.

Figure 10:
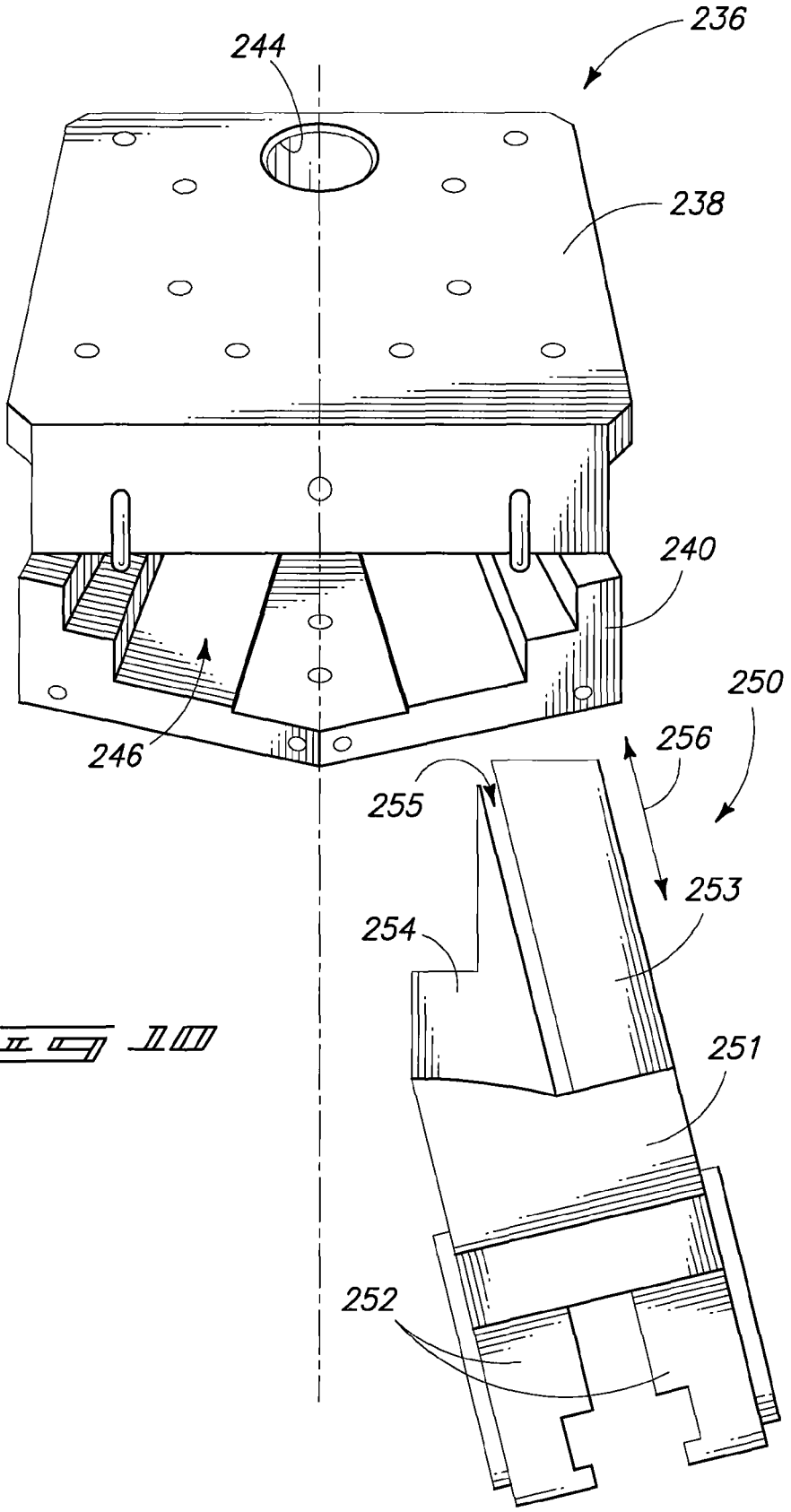
FIG. 10 is a perspective view of an exemplary main tool and an exemplary male tool used in the method of FIG. 9 according to one of various embodiments of the invention.

Referring to FIG. 10, an exemplary main tool 236 and an exemplary male tool 250 are illustrated. Main tool 236 includes two mating parts or mating halves 238 and 240 which are positioned together during method 290 to establish or form cavity 246. Cavity 246 is configured to ultimately form at least a portion of interconnect structure 30, for example, outer periphery portions of interconnect structure 30. Main tool 236 includes an opening 244 to receive molten material (also referred to as stock material or molten stock material) during method 290 out of which interconnect structure 30 is formed (stock material having been described previously, for example, thermoplastics, thermosetting plastic materials, metals and/or metal alloys). It should be understood that opening 244 may also be referred to as a sprue.

Still referring to FIG. 10, an exemplary first male tool 250 is illustrated having a central body 251. Extending from central body 251 are dies: first die 253 and second die 254. Spacing between first die 253 and second die 254 forms (or leaves) a slot 255 between dies 253 and 254. First male tool 250 further includes a clamp device 252 extending from central body 251 opposite the end from which the dies 253 and 254 extend. Clamp device 252 is used to secure first male tool 250 to a hydraulic mechanism (not shown) which will provide the capability of moving first male tool 250 in reciprocal motion 256 in and out of main tool 236 during method 290. It should be understood that method 290 will include a second male tool not shown in FIG. 10 (shown in FIG. 13) which is configured or designed the same as first male tool 250. Accordingly, all discussions with respect to first male tool 250 are applicable to the second male tool.

First die 253 of male tool 250 is configured to ultimately form first cavity 87 (see FIGS. 6 and 8) of interconnect structure 30 during method 290. Second die 254 of male tool 250 is configured to ultimately form a portion of central cavity 96 (see FIGS. 6 and 8) of interconnect structure 30 during method 290. Slot 255 of male tool 250 is configured to ultimately form first inner wall 86 (see FIG. 8) of interconnect structure 30 during method 290. Accordingly, this first male tool 250 will form substantially a first half of the interior structure of interconnect structure 30 and the second male tool will form substantially a second half of the interior structure of interconnect structure 30.

Again referring to FIG. 9, another exemplary step 292 of method 290 includes positioning each male tool 250 relative the main tool 236. At least portions of each male tool 250 will be positioned in cavity 246 of main tool 236 during method 290. For example, at least first and second dies 253 and 254 of each first and second male tool 250 will be positioned in main tool 236 during method 290. The positioning is provided using the hydraulic mechanism not shown.

Again referring to FIG. 9, another exemplary step 293 of method 290 includes spraying release agent over portions of at least one of the main tool 236 and the male tools 250. In one embodiment of the invention, step 293 includes spraying release agent on at least portions of the male tools. In one embodiment of the invention, step 293 includes spraying release agent on first and second dies 253 and 254 for both male tools and spraying release agent on main tool 236. Release agent will facilitate removal of interconnect structure 30 from main tool 236 and male tools 250 during method 290.

Again referring to FIG. 9, another exemplary step 294 of method 290 includes positioning the two mating halves 238 and 240 of the main tool 236 together and over first and second dies 253 and 254 of male tools 250. Step 294 is performed using an injection machine 260.

Figure 11:
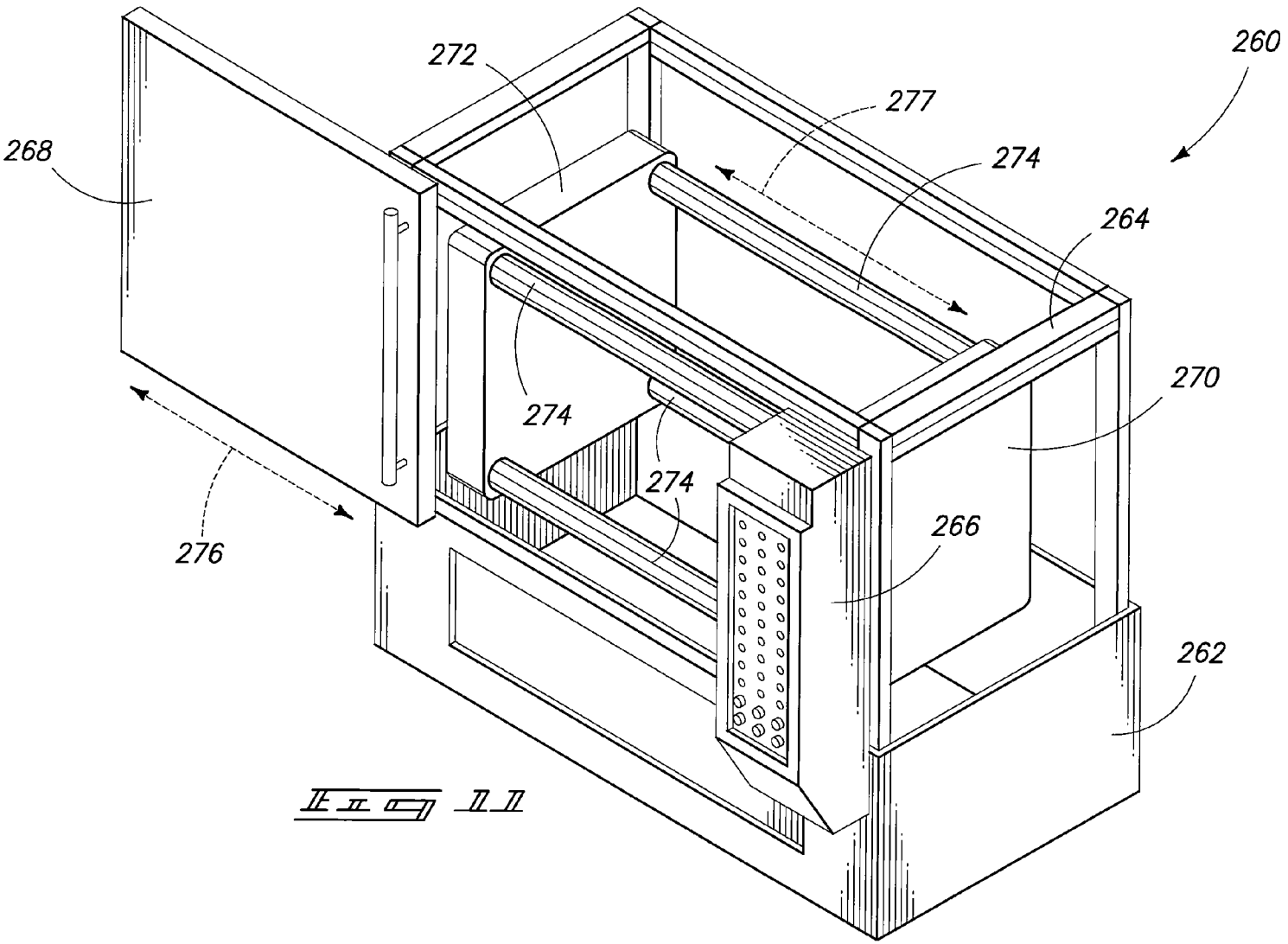
FIG. 11 is a perspective view of an exemplary injection machine used in the method of FIG. 9 according to one of various embodiments of the invention.

Referring to FIG. 11, an exemplary injection machine 260 is illustrated according to one embodiment of the invention. Injection machine 260 includes a base 262 supporting a frame 264 and a door 268 capable of reciprocal motion 276 to cover and uncover at least a front portion of frame 264. A control panel 266 is supported on frame 264 and houses circuitry, software and hardware to selectively move, at least, first pressing tool 270 and second pressing tool 272 along rails 274 in reciprocal motion 277. It should be understood that respective mating halves 238 and 240 of main tool 236 will be mounted on respective pressing tools 270 and 272 so that reciprocal motion 277 will perform step 294 of positioning the two mating halves 238 and 240 together.

Again referring to FIG. 9, another exemplary step 295 of method 290 includes melting stock material in a furnace.

Figure 12:
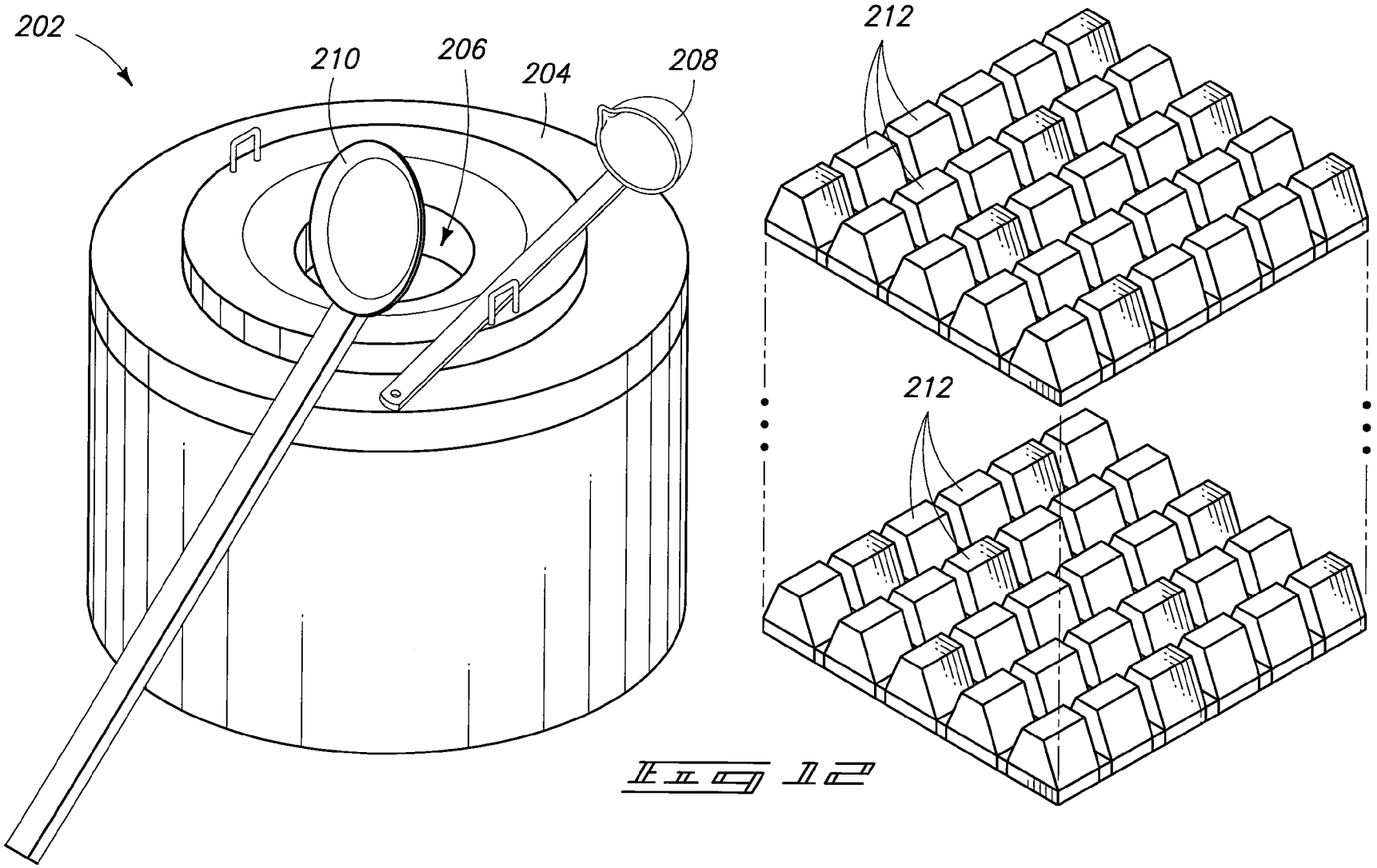
FIG. 12 is a perspective view of an exemplary furnace and an exemplary stock material used in the method of FIG. 9 according to one of various embodiments of the invention.
Figure 11:
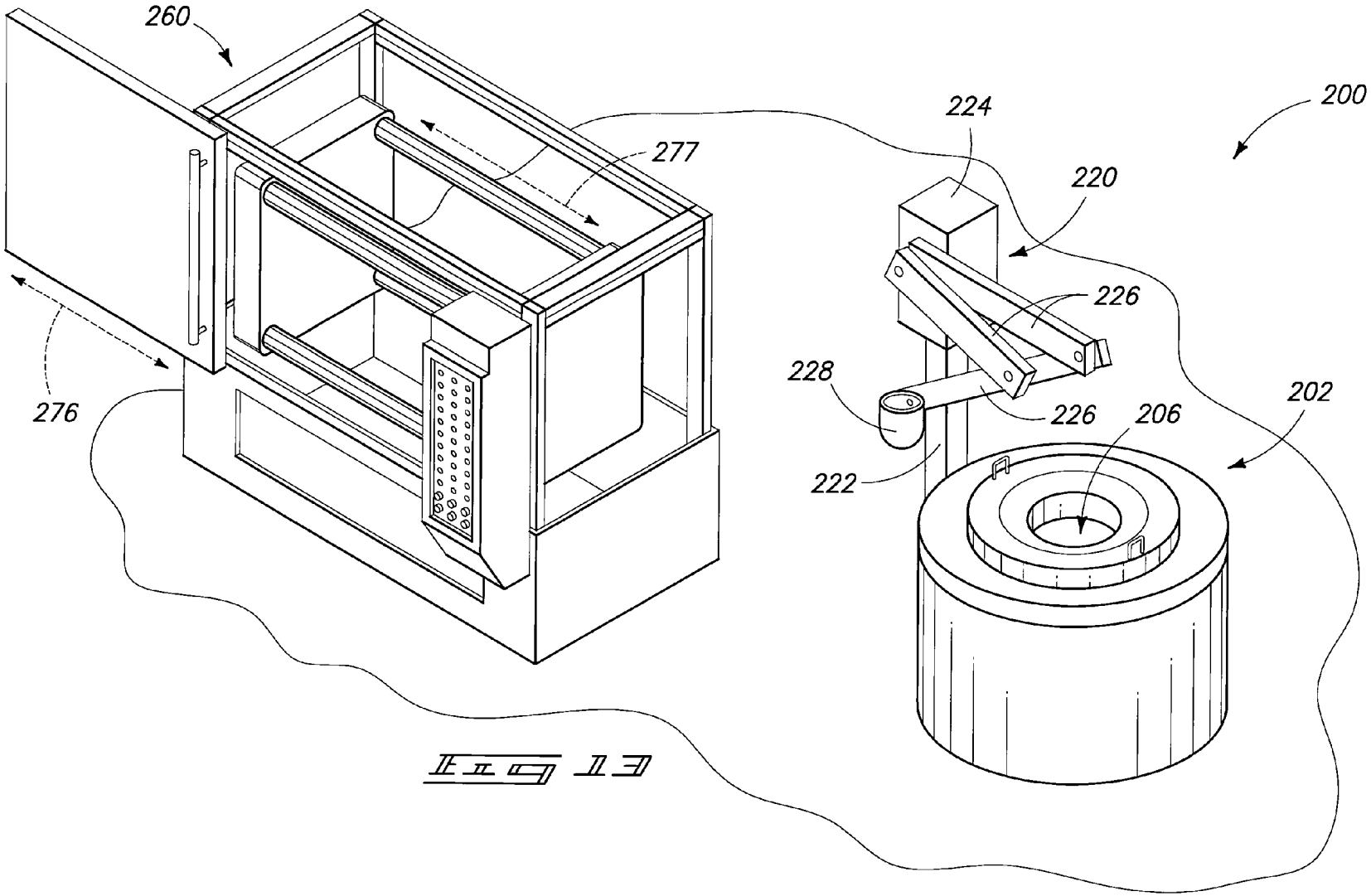

Referring to FIG. 12, an exemplary furnace 202 and exemplary stock material 212 is illustrated according to one embodiment of the invention. Stock material 212 has been described previously, for example, thermoplastics, thermosetting plastic materials, metals and/or metal alloys and can be stacked together in sheets. For one exemplary embodiment of the invention, stock material 212 comprises aluminum. An exemplary furnace 202 includes a body 204 having an opening 206 wherein opening 206 functions as an ingress for stock material 212 and egress for melted stock material 212 (molten stock material). A variety of ladles 208 and 210 are illustrated for stirring and/or stock material 212.

It should be understood, any one of steps 291-295 can be performed first and with any order combination of the other steps of 291-295. For example, step 292 can be performed first, and alternatively, step 293 can be performed first, and alternatively, step 294 can be performed first and alternatively, step 295 can be performed first and with each alternative first step, any order combination of the other steps can be performed.

Again referring to FIG. 9, another exemplary step 296 of method 290 includes transporting the molten stock material 212 from the furnace 202 to the injection machine 260. One exemplary method 290 for performing step 296 is manually moving molten stock material 212 from furnace 202 to injection machine 260 by, for example, ladles 208 and 210.

Referring to FIG. 13, an exemplary system 200 for forming interconnect structure 30 is illustrated according to one of various embodiments of the invention. System 200 includes a transport or feed machine 220 wherein another exemplary step 296 of method 290 includes automatically transporting the molten stock material 212 from the furnace 202 to the injection machine 260 by feed machine 220. Feed machine 220 includes housing 224 supported on pedestal 222 and having a coordinated collection of pivoting or control arms 226. Control arms 226 are capable of removing molten stock material 212 from opening 206 of furnace 202 and transporting the molten stock material 212 to injection machine 260. Housing 224 includes hydraulic structure and/or mechanical structure such as gears to implement movement of control arms 226.

Again referring to FIG. 9, another exemplary step 298 of method 290 includes pouring the molten stock material 212 into the injection machine 260, and particularly, pouring molten stock material 212 into opening 244 of main tool 236 while main tool 236 is in the closed position (two mating halves 238 and 240 are together). For still another exemplary step 298 of method 290 according to an embodiment of the invention, step 298 includes injecting the molten stock material 212 into opening 244 of main tool 236 under pressure.

Figure 14:
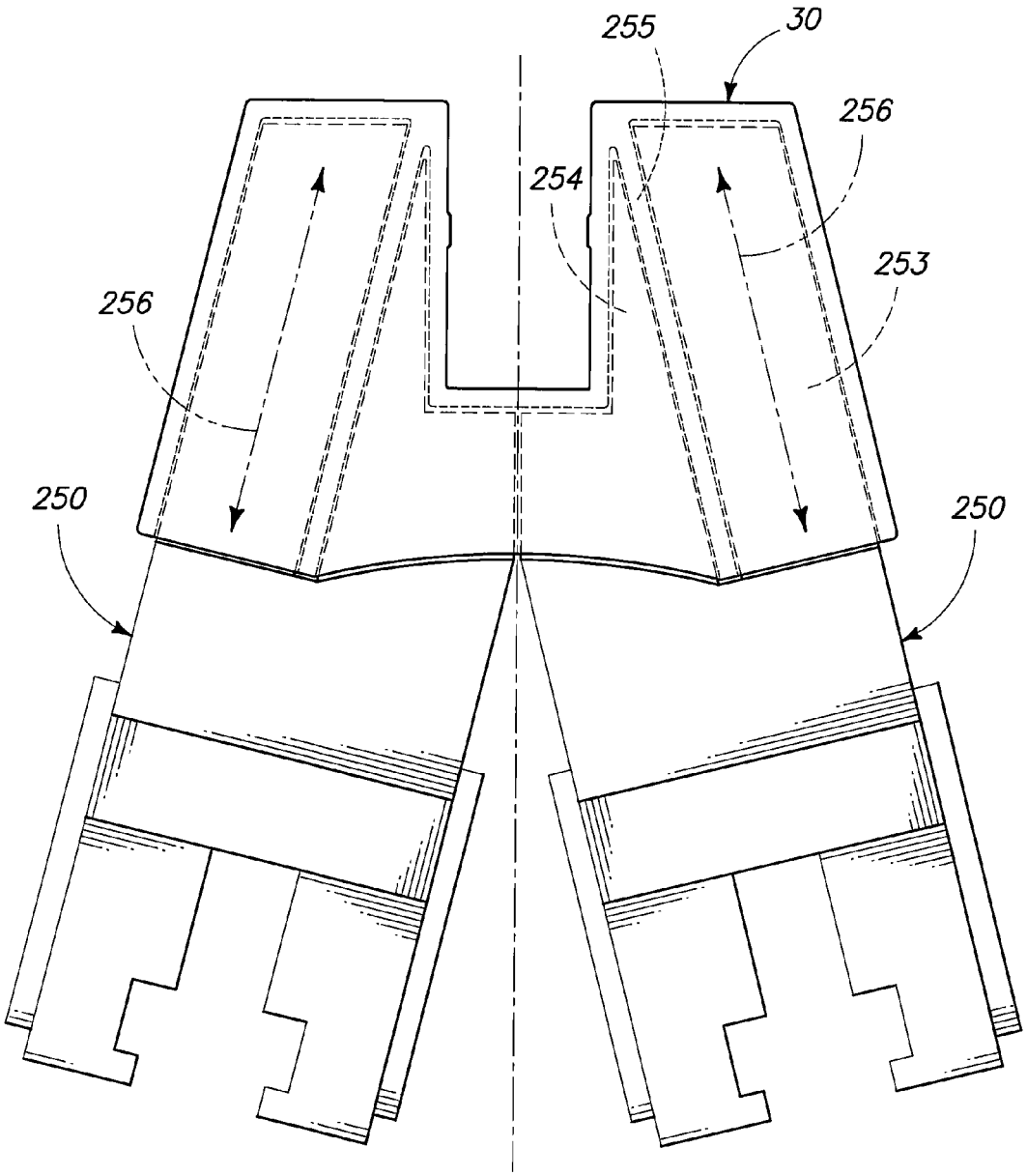
FIG. 14 is a simplified side view of an exemplary interconnect structure illustrated as being formed over first and second dies of respective male tools during the method of FIG. 9 according to one of various embodiments of the invention.

Again referring to FIG. 9, another exemplary step 299 of method 290 includes, after a span of time, removing the male tools 250 from the main tool 236. The removing of step 299 will occur along reciprocal motion 256 and implemented by the hydraulic machine not shown for which each of male tool 250 is clamped thereon. Referring to FIG. 14, an exemplary interconnect structure 30 is illustrated as being formed over first and second dies 253 and 254 of respective male tools 250.

Again referring to FIG. 9, another exemplary step 310 of method 290 includes separating the two mating halves 238 and 240 of the main tool 236 from each other. It should be understood that step 310 will be performed by injection machine 260 moving respective pressing tools 270 and 272 along reciprocal motion 277 so that respective mating halves 238 and 240 of main tool 236 will be separated. It should be further understood that step 310 can be performed before step 299.

Figure 15:
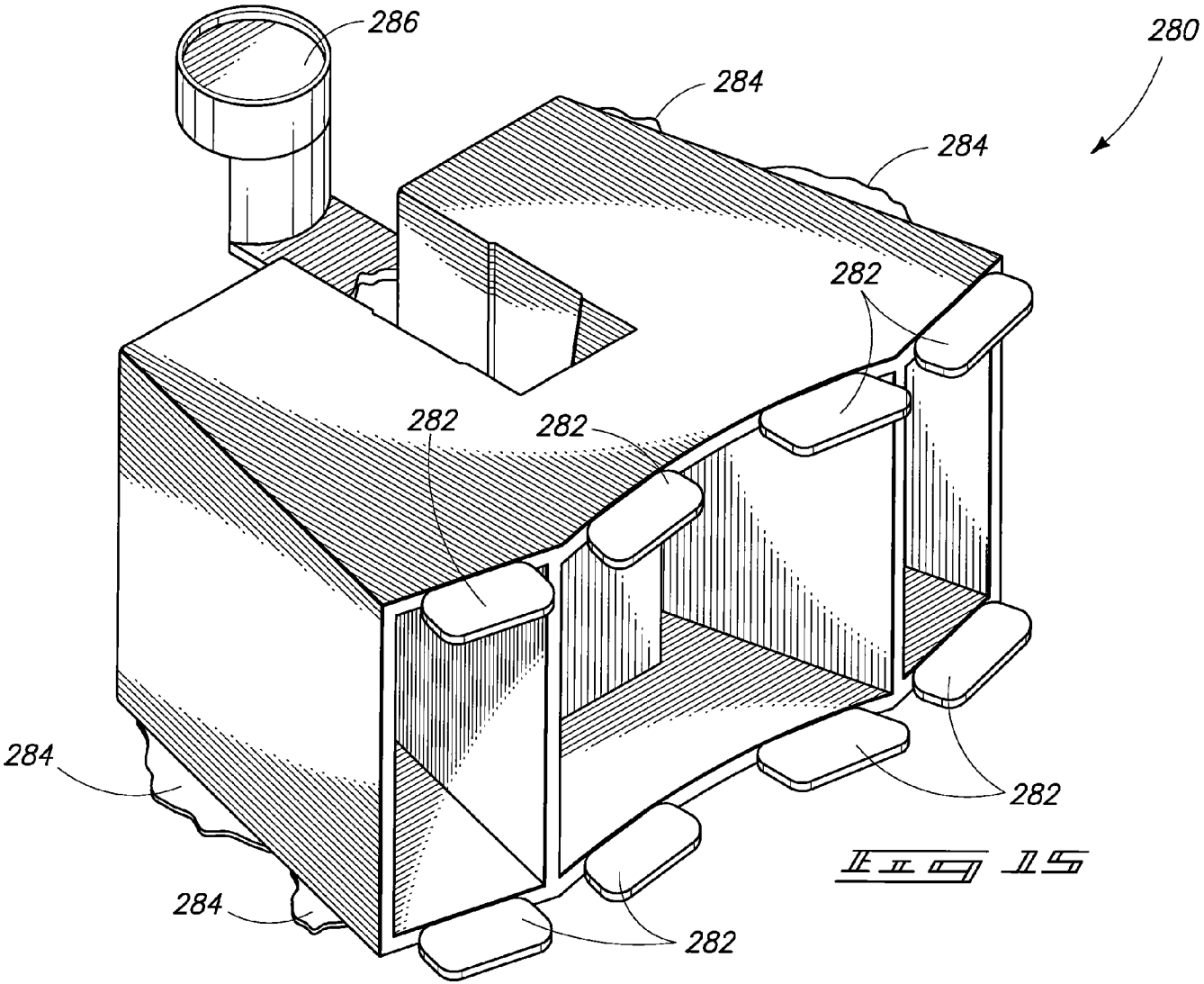
FIG. 15 is a perspective view of an exemplary interconnect structure illustrated after being removed from main tool and injection machine during the method of FIG. 9 according to one of various embodiments of the invention.
Figure 11:
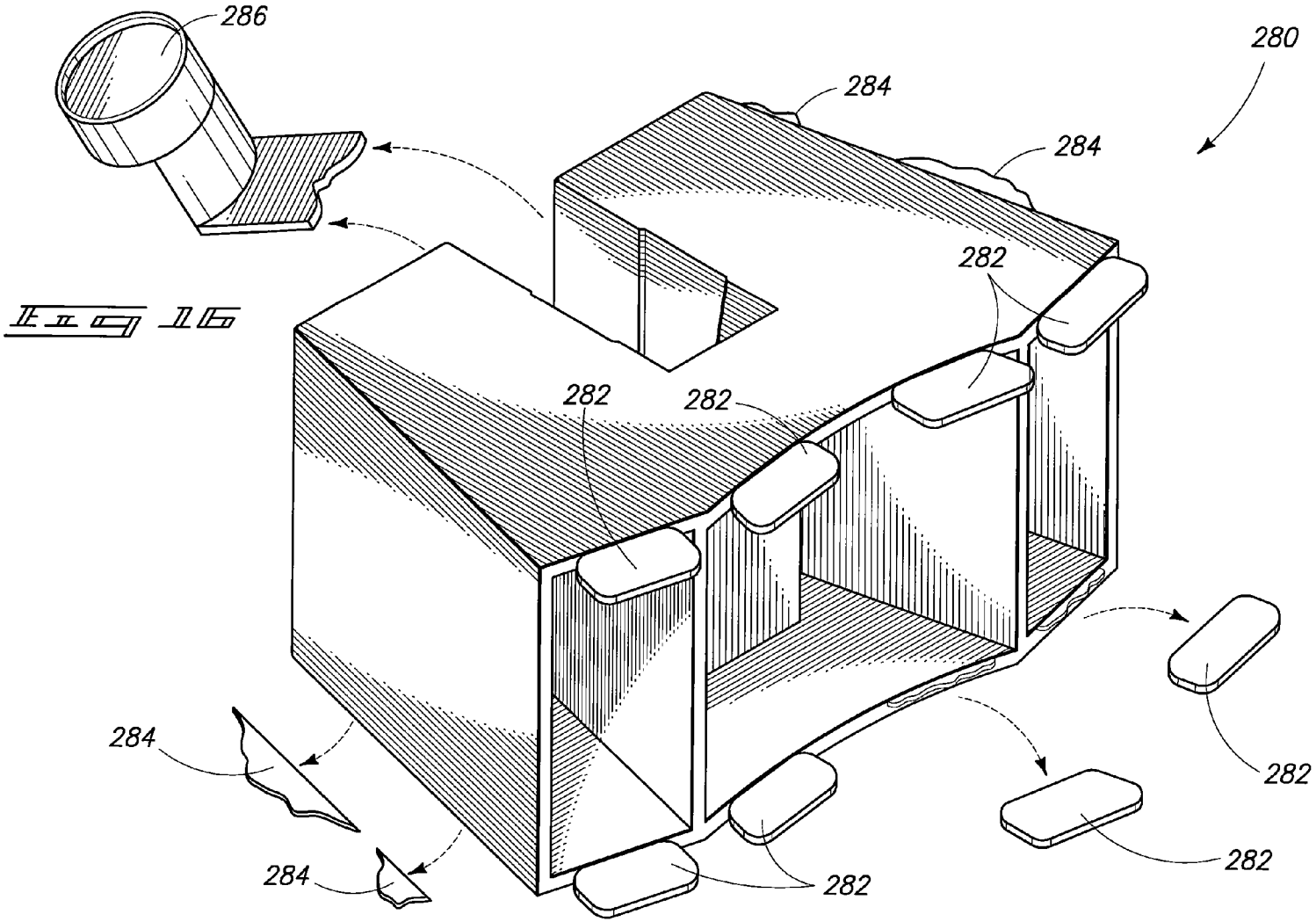

Again referring to FIG. 9, another exemplary step 311 of method 290 includes removing an interconnect structure 30 from the main tool 236 and injection machine 260. Referring to FIG. 15, an exemplary interconnect structure 30 is illustrated after being removed from main tool 236 and injection machine 260. One exemplary interconnect structure 30 includes a sprue 286 which is formed due to molten stock material remaining in opening 244 (also referred to as a sprue) of main tool 236 during method 290. Another exemplary interconnect structure 30 includes heat sinks 282. Another exemplary interconnect structure 30 includes flashings 284. It should be understood that an exemplary interconnect structure 30 can include having any combination of sprues, heat sinks and flashings, including not having any one of the structures.

Again referring to FIG. 9, another exemplary step 312 of method 290 includes removing the sprue 286, heat sinks 282 and flashings 284 from the interconnect structure 30. Referring to FIG. 16, an exemplary implementation of step 312 is illustrated according to one of various embodiments of the invention.

Again referring to FIG. 9, another exemplary step 313 of method 290 includes implementing finishing procedures to the interconnect structure 30. Exemplary finishing procedures according to various embodiments of the invention include removing sharp edges and/or protuberances from the interconnect structure 30 that may cause injury during use of interconnect structure 30.

Interconnect structure 30 being formed as a single-piece or unitary structure without two or more pieces (or sections or segments) of structure having to secured together (for example, by welding). Accordingly, interconnect structure according to the invention accomplishes the goals and advantages stated in the Background of this document. That is, the inventive interconnect structures 30 improve consistency of stability for a support apparatus (such as a sawhorse) by having low tolerances for which leg members are connected to a crossbeam, and therefore, increases the safety and versatility of the support apparatus. Furthermore, the inventive interconnect structures 30 improve the methods to connect the leg members to the crossbeam by increasing load bearing capabilities of the support apparatus in contrast to the load bearing capabilities of prior art sawhorses. Moreover, the inventive interconnect structures 30 simplify the methods for connecting leg members to a crossbeam which form a support apparatus by facilitating ease of use and consistency which again leads to safety and versatility of use for the support apparatus.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. An interconnect structure for a stand having a crossbeam, the interconnect structure comprising:

a pair of top walls;

a front wall extending from the top walls;

a rear wall spaced from the front wall and extending from the top walls, the distance between the front and rear walls establishing the entire depth dimension of the interconnect structure, the rear wall comprising the same shape configuration as the front wall; and a channel comprising a pair of inner side walls spaced apart and connected by a support surface, the support surface extending from the front wall to the rear wall and configured to be elevationally below and supporting the crossbeam; and wherein the pair of the top walls is planar and wherein the support surface of the channel is planar, the pair of the top walls is not parallel with the support surface.

2. The interconnect structure of claim 1 wherein the front wall is a planar structure and wherein the rear wall is a planar structure parallel to the front wall.

3. The interconnect structure of claim 1 wherein the top walls are coplanar structures and wherein the support surface comprises a planar upper surface that extends at an angle relative the planar top walls.

4. The interconnect structure of claim 1 wherein the support surface comprises openings configured to receive fasteners.

5. The interconnect structure of claim 1 wherein the support surface comprises a planar lowermost surface spaced from a planar uppermost surface, the lowermost surface extends at an angle relative to the uppermost surface.

6. The interconnect structure of claim 1 wherein the support surface comprises first thickness adjacent one of the rear and front walls and a second thickness adjacent the other of the rear and front walls, the first thickness being different relative the second thickness.

7. The interconnect structure of claim 1 further comprising spaced receptacles configured to receive legs of the stand, the respective receptacles terminate at bottom portions of the top walls, the receptacles configured to receive uppermost portions of the legs adjacent the bottom portions of the top walls.

8. The interconnect structure of claim 1 wherein the front wall is planar and comprises an entirety of the front-most periphery of the interconnect structure, and wherein the rear wall is planar and comprises an entirety of the rear-most periphery of the interconnect structure.

9. The interconnect structure of claim 1 wherein the support surface comprises a thickness, and wherein, as the support surface extends between the front and rear walls, the support surface increases in thickness.

10. The interconnect structure of claim 1 wherein the channel is defined by the support surface and the inner side walls extending upwardly from opposite edges of the support surface, at least one inner side wall comprising a recess.

11. The interconnect structure of claim 1 wherein the channel is defined by the support surface and the inner side walls extending upwardly from opposite edges of the support surface, at least one inner side wall comprising a ridge portion and a recess portion.

12. An interconnect structure for a stand having a crossbeam, the interconnect structure comprising:

a pair of top walls;

a front wall extending from the top walls;

a rear wall spaced from the front wall and extending from the top walls, the distance between the front and rear walls establishing the entire depth dimension of the interconnect structure, the rear wall comprising the same shape configuration as the front wall;

a channel comprising a pair of inner side walls spaced apart and connected by a support surface, the support surface extending from the front wall to the rear wall and configured to be elevationally below and supporting the crossbeam; and wherein the top walls are coplanar structures and wherein the support surface comprises a planar upper surface that extends at an angle relative the planar top walls.

13. The interconnect structure of claim 12 wherein the front wall is a planar structure and wherein the rear wall is a planar structure parallel to the front wall.

14. The interconnect structure of claim 12 wherein the support surface comprises openings configured to receive fasteners.

15. The interconnect structure of claim 12 wherein the support surface comprises a planar lowermost surface spaced from a planar uppermost surface, the lowermost surface extends at an angle relative to the uppermost surface.

16. The interconnect structure of claim 12 wherein the support surface comprises first thickness adjacent one of the rear and front walls and a second thickness adjacent the other of the rear and front walls, the first thickness being different relative the second thickness.

17. The interconnect structure of claim 12 further comprising spaced receptacles configured to receive legs of the stand, the respective receptacles terminate at bottom portions of the top walls, the receptacles configured to receive uppermost portions of the legs adjacent the bottom portions of the top walls.

18. The interconnect structure of claim 12 wherein the front wall is planar and comprises an entirety of the front-most periphery of the interconnect structure, and wherein the rear wall is planar and comprises an entirety of the rear-most periphery of the interconnect structure.

19. The interconnect structure of claim 12 wherein the support surface comprises a thickness, and wherein, as the support surface extends between the front and rear walls, the support surface increases in thickness.

20. The interconnect structure of claim 12 wherein the channel is defined by the support surface and the inner side walls extending upwardly from opposite edges of the support surface, at least one inner side wall comprising a recess.

* * * * *